US006802596B2

(12) United States Patent
Higuchi et al.

(10) Patent No.: US 6,802,596 B2
(45) Date of Patent: Oct. 12, 2004

(54) INK JET HEAD WITH PARTIALLY EXPOSED INSIDE ELECTRODE AND FABRICATION METHOD THEREOF

(75) Inventors: Kaoru Higuchi, Tenri (JP); Yasuhiro Sakamoto, Matsubara (JP); Hirotsugu Matoba, Sakurai (JP); Shigeaki Kakiwaki, Nara (JP); Hitoshi Isono, Tenri (JP); Yoshinori Nakajima, Joyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 19 days.

(21) Appl. No.: 10/023,369

(22) Filed: Dec. 14, 2001

(65) Prior Publication Data

US 2002/0080214 A1 Jun. 27, 2002

(30) Foreign Application Priority Data

| | | |
|---|---|---|
| Dec. 18, 2000 | (JP) | 2000-384365 |
| Jan. 12, 2001 | (JP) | 2001-005179 |
| Nov. 27, 2001 | (JP) | 2001-361103 |

(51) Int. Cl.[7] ..... B41J 2/045

(52) U.S. Cl. ..... 347/68

(58) Field of Search ..... 347/68, 69, 71

(56) References Cited

FOREIGN PATENT DOCUMENTS

| | | | |
|---|---|---|---|
| JP | 63-252750 | 10/1988 | B41J/3/04 |
| JP | 2-150355 | 6/1990 | B41J/2/045 |
| JP | 04307254 A | 10/1992 | B41J/2/16 |
| JP | 06218918 A | 8/1994 | B41J/2/045 |
| JP | 06218934 A | 8/1994 | B41J/2/16 |
| JP | 09094954 A | 4/1997 | B41J/2/045 |

*Primary Examiner*—Judy Nguyen
(74) *Attorney, Agent, or Firm*—Edwards & Angell, LLP; David G. Conlin; Richard J. Roos

(57) ABSTRACT

In a droplet spray apparatus spraying out ink from an ink path by altering the volume of an ink channel formed in a trench that is covered with a cover plate and that has a conductive member provided at one end formed at a piezoelectric member, an ink supply opening to supply ink is provided at the end side where the conductive member is provided. Accordingly, an ink jet head that can be made compact, fabricated easily, and superior in productivity is obtained.

19 Claims, 23 Drawing Sheets

INK JET HEAD WITH PARTIALLY EXPOSED INSIDE ELECTRODE AND FABRICATION METHOD THEREOF

BACKGROUND OF THE INVENTION

1. Field of the Invention

The present invention relates to improvement of an ink jet head spraying out ink by altering the volume of an ink channel formed at a piezoelectric member and a fabrication method of such an ink jet head.

2. Description of the Background Art

As conventional ink jet heads disclosed in, for example, Japanese Patent Laying-Open Nos. 63-252750 and 2-150355, an ink jet printer head having a plurality of parallel-arranged channels that can apply pressure onto the ink is proposed.

The aforementioned conventional art is superior in that an ink jet printer head that has nozzles at high density with a relatively simple structure can be realized. However, these heads had a problem in usage application from the standpoint of fabrication since it is necessary to form the channel constituted by many trenches at high density and establish electrical wiring from respective trenches.

As a method to solve such problems, Japanese Patent Laying-Open Nos. 4-307254, 6-218918 and 6-218934 propose the method of establishing electrical interconnection using a sealing member, wherein one end of a channel which is a trench is sealed by a soldering material, a coat, or a conductive member.

The conventional art will be described with reference to FIGS. 30–33.

Referring to FIG. 30, an ink jet printer head 1 includes a piezoelectric plate 27, a cover plate 3, a nozzle plate 31, and a substrate 41. Piezoelectric plate 27 is formed of a ceramic material of lead zirconate titanate (PZT) that has ferroelectricity. Piezoelectric plate 27 is subjected to a poling process in the direction of a polarization direction 5.

Piezoelectric plate 27 has a plurality of trenches 8 formed by cutting and grinding through the rotation of a diamond cutting disk. These trenches 8 have the same depth and are arranged in parallel. A sidewall 11 which is the side plane of trench 8 is polarized in the direction of arrow 5 by the poling process.

At the inner plane of the sidewall of trench 8, a metal electrode 13 is formed by vapor deposition. In the formation process of metal electrode 13, piezoelectric plate 27 is positioned oblique to the vapor emitting direction indicated by the arrow from a target or vapor deposition source not shown, as shown in FIG. 31. Upon emission of vapor, metal electrodes 13 and 10 are formed at the upper half of the side plane of trench 8 and at the top plane of sidewall 11 by the shadow effect of sidewall 11.

Then, piezoelectric plate 27 is rotated 180 degrees, and metal electrodes 13 and 10 are formed in a similar manner. Thus, metal electrodes 13 and 10 are formed at the upper half of both side planes of trench 8 and the top face of sidewall 11. Metal electrodes 13 and 10 are formed of aluminum, nickel, and the like.

Then, a conductive member 26 is embedded in trench 8 by a dispenser 25 (refer to FIG. 3). Conductive member 26 is heated by a device not shown to be rendered solid. Conductive member 26 is formed in the vicinity of an end portion 15 of piezoelectric plate 27. Trench 8 is filled entirely with conductive member 26. Then, the excessive portion of conductive member 26 and metal electrode 10 at the top plane of sidewall 11 are removed by lapping or the like.

Cover plate 3 shown in FIG. 30 is formed of a ceramic material or resin material and the like. Cover plate 3 has an ink inlet 21 and a manifold 22 formed by grinding, cutting or the like.

As shown by the sectional configuration of trench 11 of FIG. 32, the working side plane of trench 8 of piezoelectric plate 27 and the working side plane of manifold 22 are connected by an adhesive 4 of an epoxy type or the like. Accordingly, ink jet printer head 1 is constituted by a plurality of ink channels 12 spaced apart from each other laterally and having the top face of trench 8 covered. All ink channels 12 are filled with ink.

At the end plane of piezoelectric plate 27 and cover plate 3, a nozzle plate 31 having a nozzle 32 provided corresponding to the position of each ink channel 12 is attached. Nozzle plate 31 is formed of plastic such as polyalkylene (for example ethylene), terepthalate, polyimide, polyetherimide, polyetherketone, polyethersulfone, polycarbonate, and cellulose acetate.

At the plane opposite to the working side plane of trench 8 of piezoelectric plate 27, substrate 41 is attached by an epoxy type adhesive or the like. Substrate 41 is formed with a pattern 42 of a conductive layer corresponding to the position of each ink channel 12. Pattern 42 of the conductive layer and conductive member 26 are electrically connected by wire bonding or the like.

Accordingly, metal electrode 13 located at one side plane of trench 8 and metal electrode 13 located at the other side plane are electrically connected by conductive member 26. Therefore, when voltage is applied to conductive member 26, voltage is applied at the same time to metal electrodes 13 at both sides of trench 8 through conductive member 26, whereby sidewalls 11 corresponding to the side planes of trench 8 are deformed inwards of trench 8 to spray out ink droplets.

The operation of ink jet printer head 1 will be described with reference to FIGS. 32 and 33. A driving control circuit not shown determines the spray out of ink from ink channel 12*b* of ink jet printer head 1 according to predetermined data. Then, a positive driving voltage V is applied to metal electrodes 13*e* and 13*f* via conductive pattern 42 and conductive member 26 corresponding to relevant ink channel 12*b*, and metal electrodes 13*d* and 13*g* are connected to ground.

Referring to FIG. 33, a driving electric field is generated in the direction of arrow 14*b* at sidewall 11*b* whereas a driving electric field is generated in the direction of arrow 14*c* at sidewall 11*c*. Since driving electric field directions 14*b* and 14*c* are orthogonal to the polarization direction 5, sidewalls 11*b* and 11*c* are rapidly deformed in the inner direction of ink channel 12*b* by the piezoelectric thickness slide effect. By this deformation, the volume of ink chamber 12*b* is reduced to rapidly increase the ink pressure. A pressure wave is generated to cause ink droplets to be sprayed out from nozzle 32 communicating with ink channel 12*b*.

When application of driving voltage V is ceased, sidewalls 11*b* and 11*c* gradually return to their position previous to deformation. Therefore, the ink pressure within ink channel 12*b* is gradually lowered. As a result, ink is supplied into ink channel 12*b* via manifold 12 from ink inlet 21.

Thus, the center portion of the two sidewalls 11 corresponding to respective side planes of trench 8 is caused to deform inwards of trench 8 simultaneously in order to spray out ink droplets.

In the above-described ink jet printer head 1, end portion 15 of piezoelectric plate 27 blocked by conductive member 26 must be sealed completely so that ink will not be discharged from end portion 15 even when ink channel 12 is filled with ink.

In the case where conductive member 26 is formed at the trench end portion, phase-change from a liquid phase state to a solid phase state is required. The volume change caused by the phase change produces a void in conductive member 26 to result in ink leakage. Furthermore, in the case where complete sealing is not established, another member to occlude end portion 15 of trench 8 is required. This means that the fabrication method becomes more complicated.

It is noted that manifold 22 is provided at the trench attach plane of cover plate 3. Since the ink supply opening by manifold 22 is provided during the path of the ink channel, the ink channel will become longer. Also, there is a problem that the ink channel resistance is increased since the flow is altered substantially perpendicularly at the ink channel from the ink supply opening.

Also, a longer ink channel causes a higher electric resistance at the electrode portion of the sidewall, resulting in a greater load on the drive circuit. There was a problem that the size of the ink jet printer head per se is increased.

In view of the foregoing, an object of the present invention is to provide an ink jet head that can be easily fabricated, exhibits superior productivity, and that can be made compact.

In such an ink jet head, the electrode formed inside the ink chamber is extended outside the ink chamber to form a leading outside electrode. Electrical connection is to be provided between this outside electrode and an external drive circuit including the IC (Integrated Circuit) for driving. As a connection method between an outside electrode and an external drive circuit in a conventional ink jet head, the method of using a bonding wire, the method of using a TAB (Tape Automated Bonding) lead, and the method of using a flexible substrate are known, as shown in FIGS. 34–36.

Specifically, an actuator 100 is arranged on a support 110 together with an IC 130 for driving. Actuator 100 includes a substrate 103, a cover plate 123, a nozzle plate 125 and an electrode 101 inside the ink chamber. Substrate 103 is formed of a piezoelectric element, and has a plurality of sidewalls 127 arranged in a direction perpendicular to the drawing sheet. An ink chamber 122 is formed between respective partition walls 127. Cover plate 123 includes a supply opening 124 to supply ink to each ink chamber 122, and is arranged at the top plane of substrate 103. Nozzle plate 125 has a nozzle 126 from which ink is sprayed out from each ink chamber 122, and is arranged at the front side of substrate 103. Inside electrode 101 is formed in the region range of substantially the upper half of partition wall 127 in each ink chamber 122. Inside electrode 101 is formed extending towards the back side at the top plane of substrate 103. This extending portion forms an electrode 102 outside the ink chamber for leading.

Referring to FIG. 34 corresponding to the method using a bonding wire, outside electrode 102 of actuator 100 is electrically connected to the connection point of drive IC 130 through a bonding wire 111. The connection of bonding wire 111 is carried out by the Al (aluminum) wedge wire bonding technique or Au (gold) wire bonding technique. An ultrasonic wave is applied while bonding wire 111 is heated and pressed from above through a bonding capillary towards the connection point of the top plane of outside electrode 102 that is a planar plane and drive IC 130 to effect metal solid phase diffusion bonding.

Referring to FIG. 35 corresponding to the method using a TAB lead, an outer lead 112 of a TAB device is electrically connected to outside electrode 102 of actuator 100. This connection includes the steps of pressing a lead presser having a heat pressurization mechanism from above under the state where outer lead 112 of the TAB device is positioned parallel to outside electrode 102 of actuator 100, and fusing the solder that is pre-plated at the bottom plane of outer lead 112 for solder bonding. Alternatively, an ACF (Anisotropic Conductive Film) or an ACP (Anisotropic Conductive Paste) may be used instead of the solder.

Referring to FIG. 36 corresponding to the method of using a flexible substrate, an electrode 115 for connection formed on a printed circuit board 114 on which drive IC 130 is mounted is electrically connected with outside electrode 102 of actuator 100 through a flexible substrate 113. This connection has both end portions of flexible substrate 113 mounted on each top plane of connection electrode 115 and outside electrode 102, and is effected by solder bonding or using an ACF or ACP, in a manner similar to that using the TAB lead shown in FIG. 35.

A conventional method of fabricating an actuator forming an ink jet head will be described here with reference to FIG. 37.

A dry film resist is laminated and cured on a top plane 103*a* of a substrate 103 formed of a piezoelectric element polarized in the thickness direction (vertical direction in drawing). Using the dicing blade of a dicer, top plane 103*a* is half-diced from the side of front plane 103*b* towards back plane 103*c* to form an ink chamber 122 sandwiched between partition walls 127. At the middle region of substrate 103 between front plane 103*b* and back plane 103*c*, the dicing blade is raised to form an R portion 122*a* at the back plane side of ink chamber 122. Also, the dry film resist applied at top plane 103*a* to back plane 103*c* is cut to form a planar portion 122*b*.

This dicing process is repeated in a direction parallel to front plane 103*b* and back plane 103*c* of substrate 103 to form an ink chamber array at substrate 103. Then, metal such as Al or Cu (copper) that is to become the electrode material is vapor-deposited obliquely from above substrate 103 in the longitudinal direction of ink chamber 122. By carrying out this process from two opposite directions (the direction indicated by the arrow in drawing) about ink chamber 122, inside electrode 101 is formed at respective side partition walls 127 of ink chamber 122.

At this stage, electrode 101 is formed in the area range of approximately ½ in the thickness direction of partition wall 127 from top plane 103*a* of partition wall 127 by the shadowing effect of the dry film resist and partition wall 127 in ink chamber 122. Also, oblique vapor deposition of the electrode material is carried out simultaneously at R portion 122*a* and planar portion 122*b* of ink chamber 122. Here, the thickness and opening width of the dry film resist are set so that the metal film deposited from the left and right directions overlap at planar portion 122*b*. Accordingly, an electrode (outside electrode) 102 is formed all over the opening portion of planar portion 122*b*. At R portion 122*a*, the electrode is formed so as to connect inside electrode 101 in ink chamber 122 with outside electrode 102 at planar portion 122*b*.

Then, a cover plate 123 having a supply opening 124 as shown in FIGS. 34–36 is attached at top plane 103*a* of substrate 103. Nozzle plate 125 having a nozzle 126 is attached at front plane 103*b* of substrate 103. Thus, actuator 100 is completed.

Actuator 100 formed as described above carries out shear mode driving by applying a potential of opposite phase to each other to respective inside electrodes 101 formed in an adjacent ink chamber 122 with partition wall 127 therebetween. More specifically, partition wall 127 having a potential of opposite polarity applied to respective side planes exhibits shearing deformation in an angle bracket configuration at the boundary between the region where inside electrode 101 is formed and the region where inside region 101 is not formed. This shearing deformation of partition wall 127 alters the volume of ink chamber 122, whereby the ink pressure in ink chamber 122 changes to spray out ink droplets from nozzle 126 arranged at the front plane 103*b* side of ink chamber 122.

In the conventional ink jet head of the above-described structure, the active region that contributes directly to the ink discharge of ink chamber 122 formed in actuator 100 is limited to the side of front plane 103*b* in front of supply opening 124 (the side where nozzles are formed). The back plane 103*c* side including supply opening 124 is the region to supply ink into ink chamber 122. R portion 122*a* and planar portion 122*b* are the regions to connect inside electrode 101 facing each other in ink chamber 122 to form one outside electrode 102 which serves to electrically connect an external electrode that conducts with drive IC 130. According to the structure of such an ink jet head, the portion other than the active region that contributes to ink discharge is extremely great to cause increase in the material cost. There was a problem that an economic ink jet head could not be fabricated.

It is also necessary to extend inside electrode 101 as far as planar portion 122*b* on substrate 103 that is based on a piezoelectric element such as of PZT that has high permittivity. Therefore, the electrical capacitance of substrate 103 is increased to dampen the waveform of the driving voltage that is to be applied in the drive of actuator 103. There was a problem that high speed print out by high speed driving cannot be carried out easily. Although this dampening of the waveform of the driving voltage can be alleviated by raising the applied voltage, this increase of the applied voltage will cause a great amount of generated heat by the drive of actuator 100. The viscosity of ink will change by the rise in temperature of actuator 100. Thus, there was a problem that accurate printing cannot be carried out stably. There is also a problem that the cost of driving IC 130 to apply a high voltage is increased. Furthermore, there was a problem that power consumption cannot be reduced.

In view of the foregoing, the electrical capacitance of substrate 103 at the region other than the active region is rendered to a negligible level by forming in advance a low dielectric film between the piezoelectric element and inside electrode 101 at the region other than the active region of inside electrode 101 of actuator 100. However, an expensive ECR-CVD (Electron Cyclotron Resonance Chemical Vapor Deposition) device is required to form an Si—N film of low permittivity by a process of low temperature on PZT that has a low Curie point of approximately 200° C. The fabrication cost will become so high that an economic ink jet head cannot be fabricated.

Japanese Patent Laying-Open No. 9-94954 discloses a structure of avoiding the formation of the region of a supply opening 214*a* and the extension of an inside electrode 213 in the longitudinal direction of the piezoelectric element. According to this structure, ink is supplied into an ink chamber 214 through a supply opening 214*a* provided at the trailing end portion of the active region of substrate 210. Inside electrode 213 formed in ink chamber 214 extends from a discharge hole 212 towards supply opening 214*a*, and is formed integrally with an outside electrode 215 extending towards the trailing end plane of substrate 210. Inside electrode 213 is electrically connected with an electrode 217 conducting with drive IC 216 in outside electrode 215.

According to this structure, the material cost of the piezoelectric element can be reduced since there is no region other than the active region of actuator 200. However, there is a problem that the electrical capacitance of substrate 210 is increased. Furthermore, since inside electrode 213 is bent 90° at the side plane of actuator 200 so as to extend outside electrode 215, outside electrode 215 cannot be formed simultaneously during the oblique vapor deposition process of forming inside electrode 213 in the wafer status.

Inside electrode 213 and outside electrode 215 at the side plane of actuator 200 will be formed after each actuator 200 is cut out (diced into a small piece) from the wafer. However, in order to lead out the two inside electrodes 213 facing each other in ink chamber 214 while ensuring an electrically conductive state, oblique vapor deposition is required from at least two further directions. In order to isolate outside electrode 215 extending to the side plane of actuator 200 for each ink chamber 214, a patterning process must be carried out in advance. In the case where patterning is not carried out, an electrode isolation process by dicing or using a YAG laser is required after the draw out of the bare electrode. Since the fabrication step becomes more complicated, the productivity is poor and the yield is degraded. There was a problem that the production cost is increased.

Although the outer wiring can be formed also by plating, a patterning step or an electrode isolation step is required as by the vapor deposition technique. Thus, there was a problem that the processing step becomes more tedious. There is also the possibility that the outgoing electrode is disconnected at the bending portion from ink chamber 214 at the side plane of actuator 200 by a subsequent process or handling. There was a problem that the production yield as well as the environment reliability are degraded.

In view of the foregoing, another object of the present invention is to provide an ink jet head and a fabrication method thereof that can prevent increase of a substrate area without raising the cost caused by the usage of an extensive fabrication apparatus, complication of the fabrication step, and degradation of the yield due to disconnection of the electrode, and that can prevent increase of the material cost as well as prevent increase of the electrical capacitance of the substrate to allow stable high speed print out in high accuracy without increase of the heat generated in the actuator, and a method of fabricating such an ink jet head.

SUMMARY OF THE INVENTION

An ink jet head of the present invention causes deformation of partition walls to discharge ink from an ink chamber by having an inside electrode formed at each inner side plane of one pair of partition walls sandwiching a trench-like ink chamber, and electrically connected to an external drive circuit, and applying a driving pulse from the external drive circuit to the inside electrode in the ink chamber. The ink jet head of the present invention includes a substrate having a partition wall constituted by forming an ink chamber trench located from one end plane to the other end plane. The end plane of the inside electrode located at only the interior of the ink chamber trench is exposed at the other end plane. The external drive circuit is electrically connected to the inside electrode at the other end plane. An ink supply opening to supply ink into the ink chamber is provided at the other end plane side.

According to such a structure, the ink supply opening is provided at the other end plane side. Therefore, it is not necessary to completely seal the other end plane of the piezoelectric plate with a conductive member. The reliability and productivity are increased.

Since an ink supply opening is not provided in the path of the ink channel, the length of the ink channel can be shortened. A compact ink jet printer can be realized. Also, the electrical resistance of the inside electrode portion can be reduced to alleviate the load of the drive circuit.

The ink flow is substantially linear from the supply opening to the ink channel. Therefore, a flow of no resistance can be provided to allow ink to be discharged stably.

The inside electrode is located only inside the ink chamber trench, and has its end plane exposed at the other end plane of the substrate. Therefore, the lead out of the inside electrode to outside the ink chamber trench for mounting in the conventional device is dispensable in the present invention. Any portion other than the active area of the actuator is practically no longer required, so that the material cost can be reduced. Also, reduction of the electrical capacitance allows improvement of the driving frequency. Therefore, high speed print out can be realized. Since the breakdown voltage of the drive IC can be lowered due to the reduction of the driving voltage, the cost of the drive IC as well as the power consumption for driving can be reduced.

The above ink jet head preferably comprises a cover plate attached at the surface of the substrate where the ink chamber trench is formed. The ink jet head is characterized in that the ink supply opening is provided at least at the cover plate side.

By forming the ink supply opening at the cover plate side, ink can be introduced straight into each ink channel along the cover plate.

Preferably, the above ink jet head further comprises a filling member formed between the pair of partition walls at the other end plane of the ink chamber trench.

Preferably, the above ink jet head further comprises a protection film to protect the connection portion where the inside electrode is electrically connected to the external drive circuit.

By providing insulative protection on the connection portion by the protection film, the connection portion can be protected in the case where conductive ink is used.

In the above ink jet head, the filling member is formed of a conductive material, and the external drive circuit and the inside electrode are electrically connected via the filling member.

In the above ink jet head, the filling member is preferably a conductive resin that occludes the other end plane of the ink chamber trench between a pair of partition walls.

According to such a structure, the other end plane of the ink chamber trench is occluded by a conductive resin. The conductive resin prevents ink leakage from the other end plane in the ink discharge direction of the ink chamber. Almost all the region in the ink chamber serves as an active region to output ink. Therefore, the material cost of the piezoelectric element forming the ink chamber is reduced. Also, the electrical capacitance of the substrate will not be increased.

In the above ink jet head, the filling member preferably includes a conductive filler of a predetermined configuration formed of a predetermined material.

According to such a structure, the other end plane in the direction of ink discharge of the ink chamber between the pair of partition walls is occluded by the filling member of a conductive material including a conductive filler of a predetermined configuration formed of a predetermined material. Therefore, the material of the conductive filler can be selected depending upon whether improvement of the driving frequency or reduction of the cost is to be given weight. The configuration of the conductive filler can be selected depending upon whether the connection resistance is to be reduced by the effective damage of the oxidation film of the electrode or by the increase of the contact area per unit volume. By using a conductive resin including such a conductive filler, connection is established between the electrode inside the ink chamber and the external drive circuit in a state where the function corresponding to the usage application is realized.

As the material of the conductive filler, Au or Ag can be used.

According to such a structure, the connection resistance between the electrode inside the ink chamber and the external drive circuit can be suppressed to a low level. The waveform of the driving voltage to drive the actuator will not be dampened. The driving frequency can be increased to correspond to high speed print out.

Furthermore, as the material of the conductive filler, Ni, Cu or carbon can be used.

By such a structure, a conductive resin can be constituted by a relatively economic material to allow reduction of the cost.

Regarding the configuration of the conductive filler, an acute portion can be provided at the outer peripheral portion.

According to such a structure, the oxide film at the surface of the electrode can be broken effectively by the contact with the conductive filler during the filling step of the region between one pair of partition walls with the conductive resin. The contact resistance between the electrode and the external drive circuit can be reduced.

Furthermore, substantially sphere configuration can be employed as the configuration of the conductive filler.

By such a structure, the density of the conductive filler in the conductive resin can be maximized to increase the contact area per unit volume of conductive resin. Accordingly, the contact resistance between the electrode and the external drive circuit can be reduced.

The greatest diameter of the conductive filler can be set to less than the distance between one pair of partition walls of the ink chamber. By such a structure, the conductive resin including the conductive filler can reliably fill the pair of partition walls.

The glass transition point of the resin material can be set to at least 60° C.

By such a structure, sufficient reliability can be achieved at the storage temperature region and usage temperature region of the ink jet head.

In the above-described ink jet head, the filling member preferably is solder that occludes the other end plane of the ink chamber trench between each inside electrode formed at each side plane of the pair of partition walls.

In such a structure, the other end plane of the ink chamber trench is occluded by solder between the pair of partition walls. Therefore, sufficient strength is achieved at the connection portion when the inside electrode is electrically connected to the external drive circuit. Thus, the reliability of the connection state is improved.

The solder can be Sn base solder.

By such a structure, electrical connection can be established between the electrode and the external drive circuit using solder that is relatively economic and readily available. Therefore, the cost can be reduced. The element to be added as well as the added amount can be changed easily. The melting temperature can be easily adjusted depending upon the temperature condition in the connection step between the electrode and the external drive circuit. Therefore, change in the fabrication step and specification can be easily accommodated.

The melting point of the solder can be set to at least 80° C.

By such a structure, sufficient reliability can be achieved at the storage temperature region and usage temperature region of the ink jet head.

According to above-described ink jet head, the filling member has the exposed portion out of the ink chamber trench electrically connected to the connection terminal of the external drive circuit.

By such a structure, the exposed portion from the ink chamber of the conductive material that occludes the other end plane of the ink chamber trench between the pair of partition walls is electrically connected to the connection terminal of the external drive circuit. The connection terminal of the external drive circuit will not form direct contact with the substrate where the ink chamber is formed. The connection portion between the inside electrode and the external drive circuit will not be affected by the deformation of the partition wall caused by the application of a driving voltage to the electrode.

In the above-described ink jet head, the filling member is preferably the connection terminal of the external drive circuit inserted to the other end plane of the ink chamber trench.

In such a structure, electrical connection is established between the inside electrode and the external drive circuit by inserting the connection terminal of the external drive circuit to the other end plane of the ink chamber trench. Therefore, the electrode inside the ink chamber can be electrically connected to the external drive circuit readily.

In the above-described ink jet head, the filling member preferably includes the conductive resin occluding the other end plane of the ink chamber trench between each inside electrode formed at each wall of the pair of partition walls, and the connection terminal of the external drive circuit inserted to the other end plane of the ink chamber trench.

In such a structure, the connection terminal of the external drive circuit is inserted into the other end plane of the ink chamber trench filled with the conductive resin. Therefore, the electrode in the ink chamber is electrically connected to the external drive circuit through the connection between the conductive resin and the conductive terminal.

In the above-described ink jet head, the conductive resin occluding the region between the electrodes in the ink chamber is preferably a conductive adhesive.

In such a structure, electrical connection is established at the other end plane of the ink chamber trench via a conductive adhesive between the inside electrode and the connection terminal of the external drive circuit. Therefore, the connection terminal of the external drive circuit is inserted into the other end plane of the ink chamber trench without direct contact with the partition wall of the ink chamber. Therefore, the partition wall will not be damaged. Furthermore, the impact at the time of inserting the external terminal of the external drive circuit to the other end plane of the ink chamber trench is alleviated by the conductive adhesive to prevent occurrence of strain caused by vibration.

Preferably in the above-described ink jet head, an anisotropic conductive adhesive can be employed as the conductive adhesive.

By such a structure, the application of the anisotropic conductive adhesive at the other end plane including the partition wall of the ink chamber allows mechanical connection between the substrate and the external drive circuit at the same time of the electrical connection between the inside electrode and the connection terminal of the external drive circuit.

Preferably in the above-described ink jet head, the connection terminal of the external drive circuit is deformed by the abutment with the conductive resin when inserted into the other end plane of the ink chamber trench.

Therefore, the impact generated during the insertion of the connection terminal of the external drive circuit to the other end plane of the ink chamber is buffered by the connection terminal to prevent damage of the partition wall and generation of strain caused by vibration. A similar effect can be obtained when either or both of the inside electrode and the filling member exhibit deformation at the time of insertion of the filling member.

Preferably in the ink jet head, the other end plane of the ink chamber trench has a guide portion formed. The guide portion is configured to introduce the filling member inside the ink chamber trench.

In such a structure, the filling member is introduced into the ink chamber trench by the guide portion at the time of insertion to the other end plane of the ink chamber trench. This ensures the insertion of the filling member in the ink chamber trench.

The guide portion may have an inclining plane at the other end plane in which the opening diameter becomes smaller from the edge of the ink chamber trench towards the interior.

By such a structure, the abutment of the connection terminal of external drive circuit against the inclining plane allows the guidance of the connection terminal of the external drive circuit inside the ink chamber along the inclining plane. The process of inserting the connection terminal of the external drive circuit into the ink chamber can be simplified.

The above-described ink jet head preferably comprises a connection conductor layer electrically connected to the electrode inside the ink chamber. The end plane of the connection conductor layer located only inside the ink chamber trench is exposed at the other end plane. Electrical connection with the external drive circuit is established at the end of the exposed connection conductor layer.

Accordingly, both of the electrodes forming a pair inside the ink chamber can be electrically connected by connecting the external drive circuit to just one of the inside electrodes facing each other with the ink chamber trench therebetween.

In the above-described ink jet head, the area of the cross section of the end plane of the inside electrode exposed at the other end plane is preferably at least $7\times10^{-5}$ mm$^2$.

Accordingly, in the connection process with the electrode electrically connected to the IC for driving the ink jet head carried out subsequently, sufficient reliability can be achieved in the electrode connection using an ACA (Anisotropic Conductive Adhesive) or NCA (Non-Conductive Adhesive).

Preferably in the above-described ink jet head, at least either the inside electrode or the connection conductor film has a metal film plated at the surface.

It is necessary to ensure sufficient thickness of the electrode since the inside electrode and the connection conductor layer are employed as the electrode for connection with the external drive circuit. The formation of a metal film through a vacuum process such as vapor deposition and sputtering is disadvantageous in productivity since the throughput is slow. However, by forming only the seed layer for plating thin by the vacuum process and forming a metal film of the desired thickness by plating, the productivity can be improved. The film quality of the metal film per se is uniform. The internal stress can be alleviated to reduce the defect of metal film peeling. An economic ink jet head stable in quality and high in reliability can be realized.

The above-described ink jet head preferably includes a filling member so as to occlude the other end plane side of the ink chamber trench between the pair of partition walls. The filling member includes either a conductive resin or an insulative resin.

Since a predetermined region in the ink chamber trench is filled with a conductive resin or insulative resin, the strength of the channel wafer is increased to alleviate damage in the subsequent dicing process into small pieces. The production yield can be improved. Therefore, an economic ink jet head can be realized.

In the case where a conductive resin is employed, the pair of inside electrodes in the same ink chamber trench can be electrically connected by the conductive resin. Furthermore, since the cross section plane of the conductive resin can be used as the connection electrode with the external drive circuit, a large connection area can be readily provided to allow favorable connection stability. In the case where an insulative resin is employed, fillers that have a relatively low coefficient of linear expansion such as silica filler and alumina filler can be dispersed into the additive to the resin. Therefore, the low coefficient of linear expansion of the piezoelectric element can be easily met. Damage of the piezoelectric element caused by heat stress and the like can be prevented. The environment reliability is improved.

Preferably in the above-described ink jet head, the filling member has at least the property of either an elastic modulus of not more than 10 GPa under an environment of 100° C. and below, or a coefficient of linear expansion of not more than 50 ppm/° C. under an environment of 100° C. or below.

Accordingly, the heat stress between the piezoelectric element and the filling member can be alleviated by the elastic deformation of the filling member when the elastic modulus of the filling member is not more than 10 GPa. When the coefficient of linear expansion of the filling member is not more than 50 ppm/° C., the heat stress can be reduced. Therefore, an ink jet head superior in environment reliability can be provided.

Preferably in the above-described ink jet head, each of the inside electrodes formed at the inner side plane of one pair of partition walls is electrically connected by a connection conductor layer formed along the inner wall plane of the ink chamber trench.

When each of the inside electrodes formed at each inner side plane of one pair of partition walls is not electrically connected by the connection conductor layer, i.e., electrically separated, an outside electrode conducting with the external drive circuit must be connected to the end plane of each inside electrode when the electrode conducting with an internal drive circuit is to be connected with an ACA. However, as long as each of the inside electrodes forming a pair is electrically connected by the connection conductor layer, the external electrode of the external drive circuit only has to be connected to the end plane of one of the inside electrodes using at least one ACA conductor particle in the connection of the external electrode conducting with the external drive circuit through an ACA. Therefore, the density of the scattering conductor particles of the ACA can be reduced, which allows reduction in the cost of the ACA material and is advantageous from the standpoint of insulation with respect to the inside electrode of an adjacent ink chamber trench. Accordingly, the pitch can be reduced. Thus, an economic ink jet head that allows print out at high accuracy can be provided.

A method of fabricating an ink jet head of the present invention includes the steps of forming a plurality of ink chamber trenches in a predetermined pitch at a top plane of a channel wafer of a piezoelectric element subjected to a polarization process in the thickness direction, forming an inside electrode independent to each other at each facing plane of the plurality of ink chamber trenches, attaching a cover wafer at a top plane of the channel wafer, cutting and dividing the attached channel wafer and cover wafer in a direction crossing the longitudinal direction of the ink chamber trench, and forming an ink supply opening at the cut plane.

Conventionally, the actuator is large in size and has a complicated structure. Also, the actuator had the inside electrode drawn out from the ink chamber trench for connection with an external drive circuit. In contrast, according to the fabrication method of the present invention, the channel wafer and cover wafer are cut after the inside electrode is formed in the ink chamber trench to expose the end plane of the inside electrode at the cut plane. Therefore, the external drive circuit can be electrically connected to the exposed end plane of the inside electrode without having to draw the inside electrode out from the ink chamber trench. Also, an ink supply opening can be formed at the cut plane.

Since it is not necessary to draw out the inside electrode out from the ink chamber trench, the portion other than the active area of the actuator is practically dispensable. Therefore, the material cost can be reduced. Also, since the driving frequency can be improved by reduction of the electrical capacitance, high speed printing can be realized. Reduction in the driving voltage allows the breakdown voltage of the drive IC to be reduced. Therefore, the cost of the drive IC and the power consumption can be reduced.

Furthermore, the fabrication step can be simplified since it is not necessary to form an actuator of a complicated structure.

Preferably, the ink jet head fabrication method further includes the step of forming in the fabrication method of an ink jet head, the step of forming a filling member preferably includes the step of fusing solder paste which is the conductive material by light energy.

According to the present method, the other end plane of the ink chamber in the direction of ink discharge is occluded using the fused solder paste used by local heating through light energy. Therefore, depolarization caused by excessive heat load at the active region of the ink chamber will not occur. The ink discharge performance will not be degraded.

In the above-described fabrication method of an ink jet head, the step of forming a filling member preferably includes the step of cooling the portion of the channel wafer where the filing member is not inserted.

By such a structure, the portion that becomes the active region of the ink chamber trench is forced to cool during the occlusion step of the other end plane of the ink chamber trench by the conductive material. Therefore, heat load will not act on the active region of ink chamber. Reduction in the performance of the ink discharge caused by depolarization can be reliably prevented.

The fabrication method of an ink jet head further includes the step of forming a conductor layer for connection along an inner wall plane of the ink chamber trench. The inside electrode is formed so as to come into contact with that connection conductor layer.

Accordingly, the connection with the electrode conducting with an external drive circuit effected subsequently can exhibit high mounting reliability by forming a thick metal film carried out at another step. Also, the throughput of the vacuum process is increased to improve the productivity since the electrode does not have to be made as thick as the electrode for driving. Furthermore, power consumption can be reduced without increasing the driving load of the active area of the ink jet head driven in a shear mode.

The above-described fabrication method of the ink jet head preferably includes the step of forming a filling member so as to fill a predetermined region between the inside electrodes facing each other in each of the plurality of ink chamber trenches. The channel wafer and cover wafer, after being attached, are cut at the position where the filling member is cut.

Since the filling member formed of a conductive resin or insulative resin is filled in the ink chamber, the strength of the channel wafer is increased to alleviate damage in the subsequent dicing process into small pieces. The production yield is improved to allow an economic ink jet head. In the case where a conductive resin is employed, the plurality of drive electrodes in the same ink chamber can be integrated by the conductive resin filling the ink chamber. Since the cross section of the conductive resin can be used as the electrode for connection with an external circuit, a large connection area can be obtained. The stability of connection is superior. In the case where an insulative resin is employed, a large amount of filler of a relatively low coefficient of linear expansion such as a silica filler or alumina filler can be dispersed into the additive of the resin. Therefore, the coefficient of linear expansion of the piezoelectric element can be easily met. Furthermore, damage of the piezoelectric element caused by heat stress and the like can be prevented. An ink jet head superior in environment reliability can be realized.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 12A, 12B and 12C are a back side sectional view, respectively, in the ink discharge direction, a top sectional view and a side sectional view of the main part of an ink jet head to which an electrode connection structure is applied according to a third embodiment of the present invention wherein FIGS. 12B and 12C are taken along lines XIIB—XIIB and XIIC—XIIC, respectively, of FIG. 12A.

FIGS. 14A, 14B and 14C are back sectional view in the ink discharge direction, a top sectional view and a side sectional view, respectively, of the main part of an ink jet head to which an electrode connection structure is applied according to a fourth embodiment of the present invention wherein FIGS. 14B and 14C are taken along lines XIVB—XIVB and XIVC—XIVC, respectively, of FIG. 14A.

DESCRIPTION OF THE PREFERRED EMBODIMENTS

Figure 1:
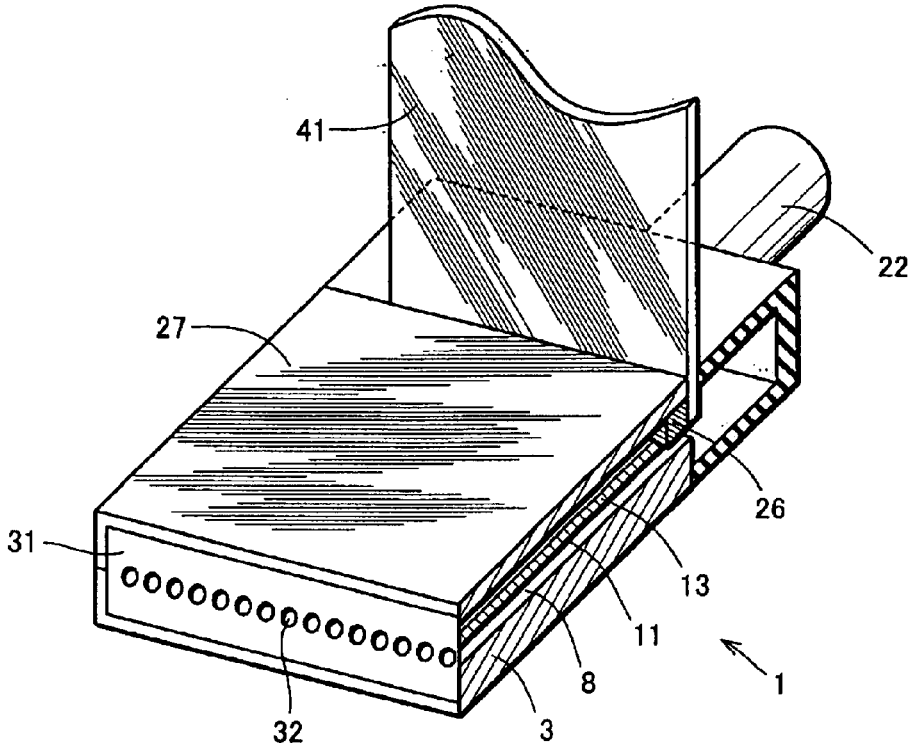
FIG. 1 is a perspective view of the cross section of the main part of an ink jet head according to a first embodiment of the present invention.

An ink jet head according to various embodiments of the present invention will be described in detail hereinafter with reference to the drawings. In respective embodiments, elements identical to (or equivalent to) those of the conventional example have the same reference characters allotted, and description thereof will not be repeated.

First Embodiment

Figure 2:
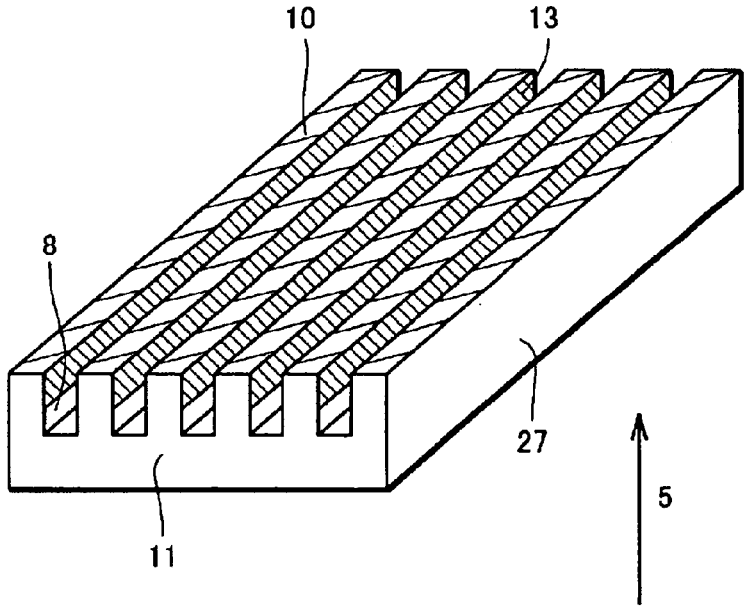
FIG. 2 is a perspective view of the formation of a piezoelectric member according to the first embodiment.

FIGS. 1–6 and 11 correspond to the first embodiment. Referring to FIG. 1, an ink jet head (droplet spray apparatus) 1 includes a piezoelectric plate (piezoelectric member) 27, a cover plate 3, a nozzle plate 31, and a substrate 41. Piezoelectric plate 27 shown in FIG. 2 is formed of a ceramic material of the lead zirconate titanate (PZT) type having high ferroelectricity.

Piezoelectric plate 27 is a plate of approximately 1 mm in thickness subjected to a poling process in the direction of arrow 5. Piezoelectric plate 27 has a plurality of trenches 8 formed at the top plane by cutting through the rotation of a diamond cutting disc. Trenches 8 are parallel to each other and have the same depth. Trench 8 has a thickness of approximately 300 $\mu$m and a width of approximately 70 $\mu$m. The pitch of trench 8 is 140 $\mu$m.

Metal electrodes (drive electrodes) 13 and 10 are formed at the upper half of the side plane of trench 8 and on the top plane of piezoelectric plate 27. Aluminum, nickel, copper, gold and the like are employed for metal electrodes 13 and 10.

Figure 3:
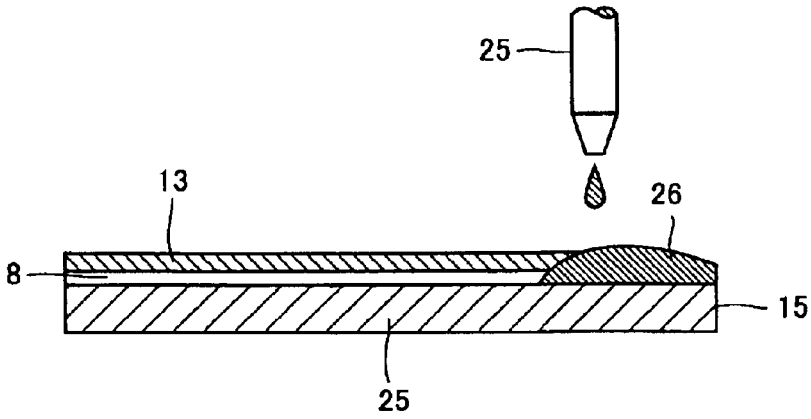
FIG. 3 is a sectional view to describe an application step of a conductive member according to the first embodiment.

As shown in FIG. 3, trench 8 is filled with a conductive member 26 by a dispenser 25 to the position of 500–600 $\mu$m in width and 160–200 $\mu$m in height. By filling trench 8 with conductive member 26 leaving out a portion in trench 8, the unfilled portion of trench 8 functions as an ink supply path.

Figure 4:
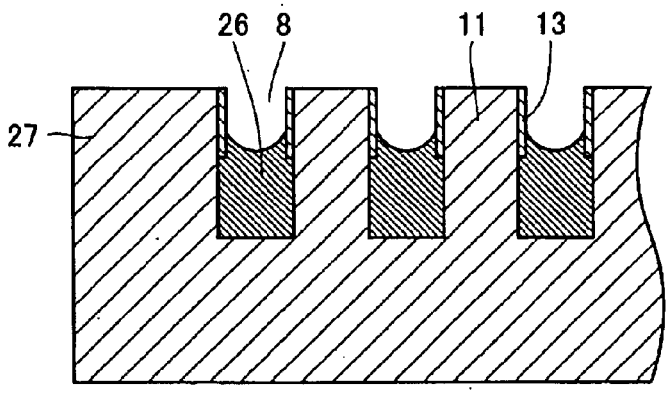
FIG. 4 is a sectional view of the conductive member formation portion of the piezoelectric member according to the first embodiment.

Referring to the sectional configuration of conductive member 26 in FIG. 4, the surface of conductive member 26 is concave by the wettability with sidewall 11. Therefore, the contacting area between conductive member 26 and metal electrode 13 is increased than the case where the surface is formed in convex. This ensures the connection between electrode 13 at sidewall 11 and conductive member 26 to prevent any problem in driving.

In the actual fabrication process, a plurality of dispensers 25 are provided, arranged above respective trenches 8. Then, conductive member 26 is heated by a device not shown to be rendered solid by the heat. As conductive member 26, gold paste, silver paste and copper paste including an epoxy type resin component, or a gold coating, or nickel plating with a plating solution as the base can be employed.

Figure 5:
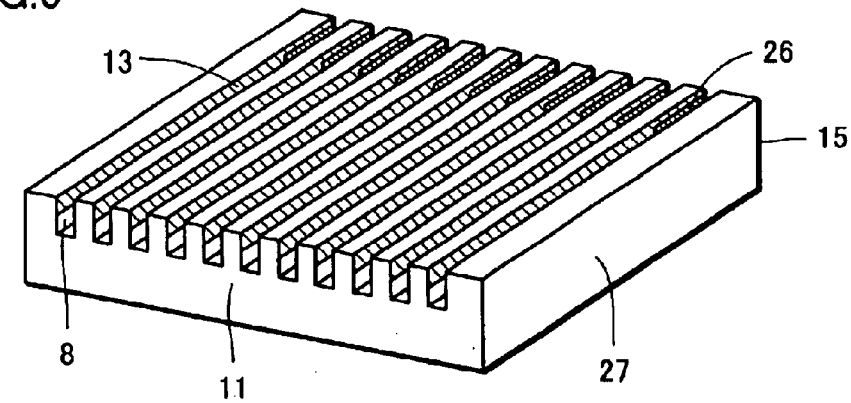
FIG. 5 is a perspective view of the piezoelectric member in the state where the conductive member is formed according to the first embodiment.

As shown in FIG. 5, conductive member 26 is formed in the vicinity of an end 15 of piezoelectric plate 27. Then, the excessive portion of conductive member 26 and metal electrode 10 at the top plane of piezoelectric plate 27 are removed by lapping and the like. The processing side plane of trench 8 of piezoelectric plate 27 and cover plate 3 are attached by an adhesive of an epoxy type or the like.

Figure 6:
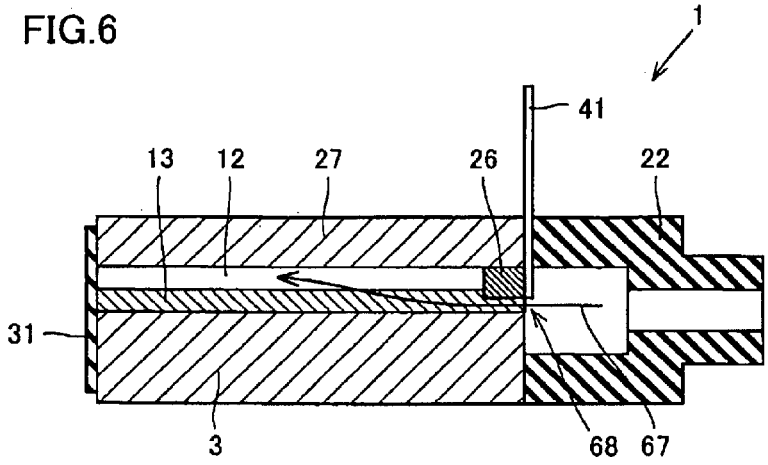
FIG. 6 is a sectional view of an ink jet head of the first embodiment.

Referring to the sectional view of the FIG. 6 along an ink channel 12 of ink jet head 1, a plurality of ink channels 12 spaced apart from each other in the lateral direction with the top plane of trench 8 covered are formed in ink jet head 1. In the ink filling step, all ink channels 12 are filled with ink between conductive member 26 and cover plate 3 (the void form above conductive member 26 in FIG. 4).

More specifically, as indicated by arrow 67, an ink supply opening 68 is formed at the end side of piezoelectric plate 27 and cover plate 3 where conductive member 26 is provided. Since ink supply opening 28 is provided at the side of cover plate 3, ink can be introduced straight into ink channel 12. The ink flow within ink channel 12 is stabilized to achieve a stable ink discharge state.

Substrate 41 having a pattern of the conductor layer (wiring pattern) 42 formed corresponding to the position of each ink channel 12 is connected to conductive member 26 formed at end 15 of piezoelectric plate 27. Connection between conductor layer pattern 42 and conductive member 26 is established by an anisotropic conductive adhesive or by forming a bump (not shown) on pattern 42 and inserting that bump into conductive member 26.

In the case where conductive ink is used, the junction portion is protected insulatively by an organic protection film such as polyparaxylene (trade name: Parylene). This protection film is dispensable depending upon the characteristics of the used ink or the adhesive used to produce an ink jet head including an anisotropic conductive adhesive.

Then, a nozzle plate 31 formed with nozzles 32 corresponding to respective ink channels 12 is attached at the end plane of piezoelectric plate 27 and cover plate 3 where conductive member 26 is not provided.

Lastly, a manifold 22 is connected to the end plane of piezoelectric plate 27 and cover plate 3 as the side where conductive member 26 is provided with substrate 41 therebetween. Reliability is improved by sealing the connecting portion so as to prevent ink leakage.

By the above-described structure, metal electrode 13 at one side plane of trench 8 is electrically connected to metal electrode 13 of the other side plate by conductive member 26. When voltage is applied to conductive member 26, a voltage will be applied simultaneously to both metal electrodes 13 located at respective side planes of trench 8 via conductive member 26. At the same time, sidewall 11 which is the side plane of trench 8 is deformed inward of trench 8, whereby ink droplets are sprayed out.

Since it is not necessary to completely seal end portion 15 of piezoelectric plate 27 with conductive member 26, the reliability and productivity is high. Since it is also not necessary to form an opening or the like to supply ink at cover plate 3, the structure is simplified. The attachment between cover plate 3 and piezoelectric plate 27 is readily performed to improve the productivity.

Also, since an ink supply opening is not provided in the path of ink channel 12, the length of the ink channel can be shortened. Furthermore, the ink flow is substantially linear as shown by the ink flowing path indicated by arrow 67 in FIG. 6. Therefore, the ink channel resistance can be suppressed to a low level.

Second Embodiment

Figure 7:
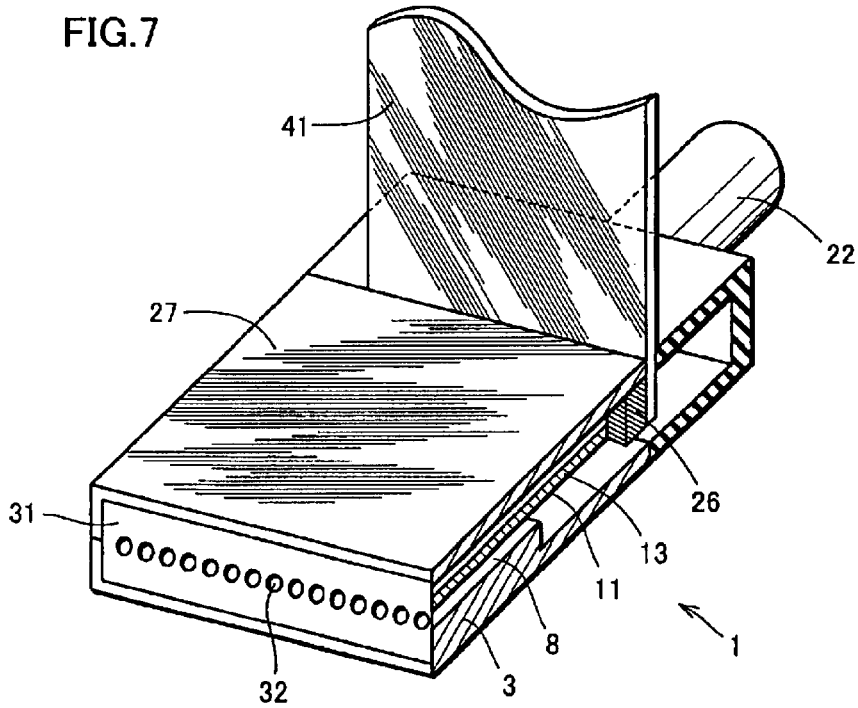
FIG. 7 is a perspective view of the cross section of the main part of an ink jet head according to a second embodiment of the present invention.
Figure 8:
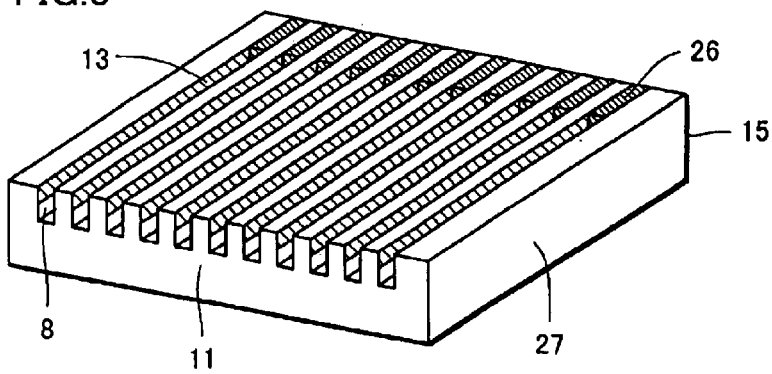
FIG. 8 is a perspective view of the piezoelectric member in a state where the conductive member is formed according to the second embodiment.

FIGS. 7–11 correspond to a second embodiment of the present invention. In contrast to the first embodiment in which cover plate 3 was planar, the ink jet head of the present embodiment has a stepped portion formed to supply ink at the end region where manifold 22 is provided. Also, conductive member 26 is inserted so as to substantially fill trench 8, as shown in FIG. 8. In this case, trench 8 does not have to be completely sealed as in the conventional case.

Referring to FIG. 7, ink jet head 1 includes a piezoelectric plate 27, a cover plate 3, a nozzle plate 31 and a substrate 41. Piezoelectric plate 27 is a plate of approximately 1 mm in thickness subjected to a poling process in the direction of arrow 5. A plurality of trenches 8 are formed at piezoelectric plate 27. These trenches 8 are parallel and have the same depths. Trench 8 has a depth of approximately 300 $\mu$m and a width of approximately 70 $\mu$m. The pitch of trench 8 is 140 $\mu$m.

Metal electrodes 13 and 10 are formed at the upper half of respective side planes of trench 8 and at the top plane of piezoelectric plate 27. Conductive member 26 fills substantially the entire depth of trench 8 at a width of 500–600 $\mu$m in trench 8 by dispenser 25. Conductive member 26 is heated by a device not shown to be rendered solid by the heat.

Figure 9:
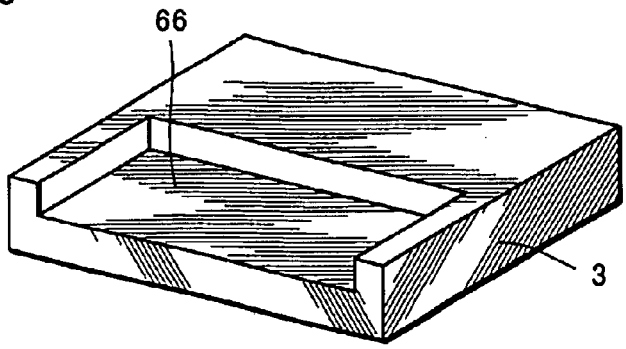
FIG. 9 is a perspective view of a cover plate according to the second embodiment.
Figure 10:
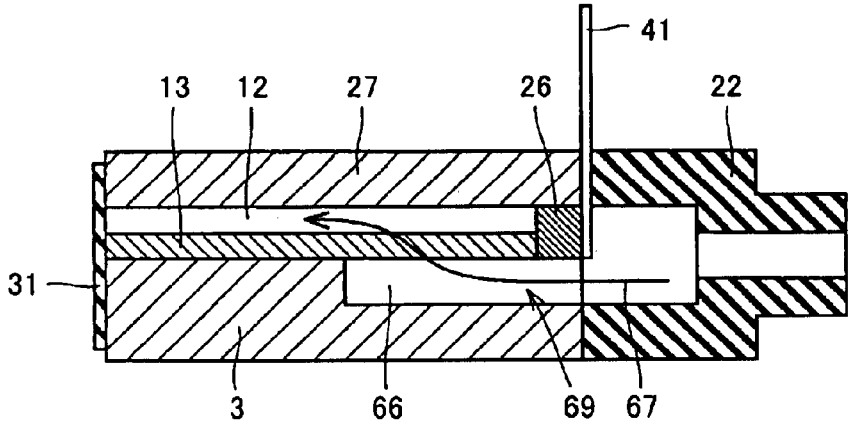
FIG. 10 is a sectional view of the ink jet head of the second embodiment.

As shown in FIG. 8, conductive member 26 is formed in the vicinity of an end portion 15 of piezoelectric plate 27. The excessive portion of conductive member 26 and metal electrode 10 (refer to FIG. 2) at the top plane of piezoelectric plate 27 are removed by lapping. Then, cover plate 3 is formed of a ceramic material or resin material to a thickness of 1 mm, as shown in FIG. 9.

Cover plate 3 has a concave 66 of •$\mu$m in depth formed at the plane facing conductive member 26 by grinding or cutting. In the previous embodiment, the gap between conductive member 26 and cover plate 3 to contribute to ink supply was 100 $\mu$m to 140 $\mu$m. In the present embodiment, the distance of the gap can be set to 500 $\mu$m as a result of processing cover plate 3.

Accordingly, ink supply opening 69 formed between conductive member 26 and the bottom plane of concave 66 of cover plate 3 can be formed to have a larger opening area.

By covering trench 8 with cover plate 3, the amount of supplied ink into the plurality of ink channels 12 formed space apart laterally can be increased. Ink can be supplied reliably in high speed printing or even in the case where consumption of ink is great by the multi nozzles.

Concave 66 is formed to have a width that can cover at least the entire trench and a length of 1000 $\mu$m to 1500 $\mu$m from the end portion to reduce the channel resistance.

Substrate 41 having a conductor layer pattern 42 formed at a position corresponding to the position of each ink channel 12 is connected to conductive member 26 formed at end portion 15 of piezoelectric plate 27. Conductor layer pattern 42 and conductive member 26 are connected by an anisotropic conductive adhesive or by forming a bump on the pattern and inserting that bump into conductive member 26.

The joining portion is protected by an organic protection film such as of polyparaxylene (parylene). This protection film is dispensable depending upon the characteristic of the used ink or the adhesive used to form ink jet head 1 including an anisotropic conductive adhesive.

Nozzle plate 31 having nozzle 32 formed corresponding to respective in channel 12 is attached at the end plane of piezoelectric plate 27 and cover plate 3 where conductive member 26 is not provided.

Finally, manifold 22 is connected to the end plane of piezoelectric plate 27 and cover plate 3 at the side where conductive member 26 is provided with substrate 41 therebetween. The reliability can be improved by sealing the periphery of the junction portion with a resin or the like so as to prevent ink leakage.

By the above-described structure, metal electrode 13 at one side plane and metal electrode 13 at the other side plane of trench 8 are electrically connected by conductive member 26. When voltage is applied to conductive member 26, voltage is applied simultaneously to metal electrode 13 at both side planes of trench 8 via conductive member 26. At the same time, sidewall 11 which is the side planes of trench 8 is deformed inward of trench 8, whereby ink droplets are sprayed out.

Since the channel resistance at the ink supply side is low, the stability during high speed driving is high in ink ejection. Also, the electrical resistance can be reduced since the contacting area between conductive member 26 and metal electrodes 13 and 10 is great. The load on the drive circuit can be reduced.

In the above first and second embodiments, modifications may be made without departing from the spirit and scope of the invention. For example, the pitch, width and depth of trench 8 formed in piezoelectric element 27 are not particularly limited. Appropriate values can be set depending upon the usage conditions and the like.

In the present embodiment, the metal electrode formed at the sidewall is provided at the upper half of the side plane. Alternatively, a structure having the metal electrode formed at the lower half and bottom of the trench can be provided by applying metal plating or the like all over the channel, and then irradiating the upper half with a laser beam to remove the metal plating therefrom.

Although the formation of a metal electrode will become more complicated in such a case, the contacting area between the conductive member and the metal electrode will become larger. Therefore, the electrical resistance at the connection portion can be suppressed. Also, the reliability of the connection portion is improved. Furthermore, since the amount of the conductive member to be filled can be reduced to less than half the trench depth, the channel resistance at the ink supply opening can be reduced to carry out ink supply and ink discharge drive stably.

Figure 11:
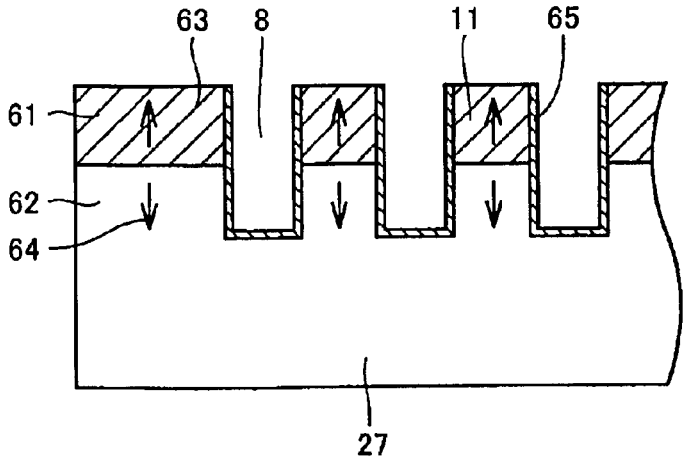
FIG. 11 is a sectional view of another piezoelectric member.

In the first and second embodiments, piezoelectric plate 27 has an integral structure. The present invention is not limited thereto. For example, as shown in FIG. 11, piezoelectric element 27 can be formed of two plates, i.e. an upper piezoelectric member 61 and a lower piezoelectric member 62, which are attached so that the polarization direction of each piezoelectric plate 27 is opposite in the thickness direction as shown by respective arrows 63 and 64. Following formation of trench 11 at the position of approximately half the height and with an opposite polarization direction, electrode 65 can be formed all over trench 11. An effect similar to that of the previous embodiments can be obtained in this case.

Third Embodiment

Figure 12A:
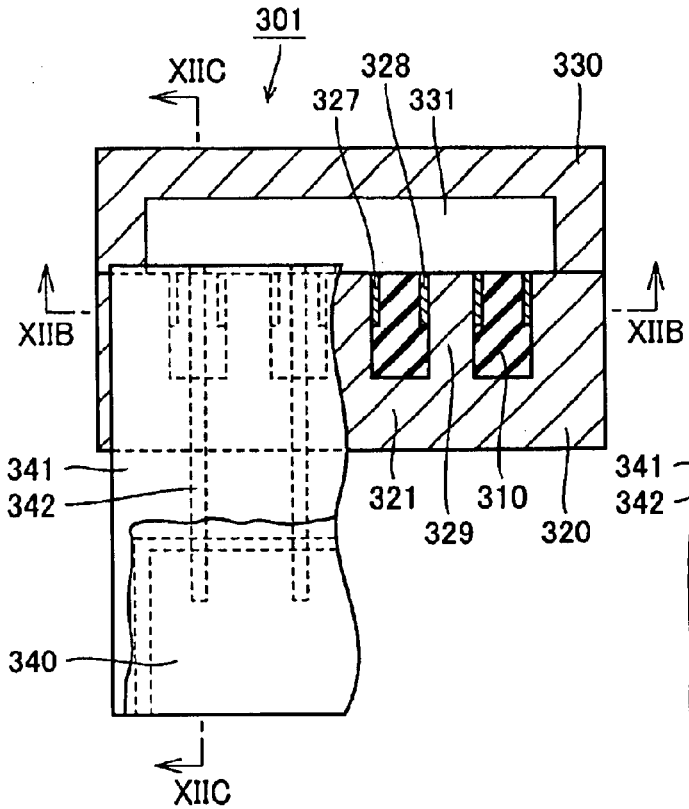
Figure 12C:
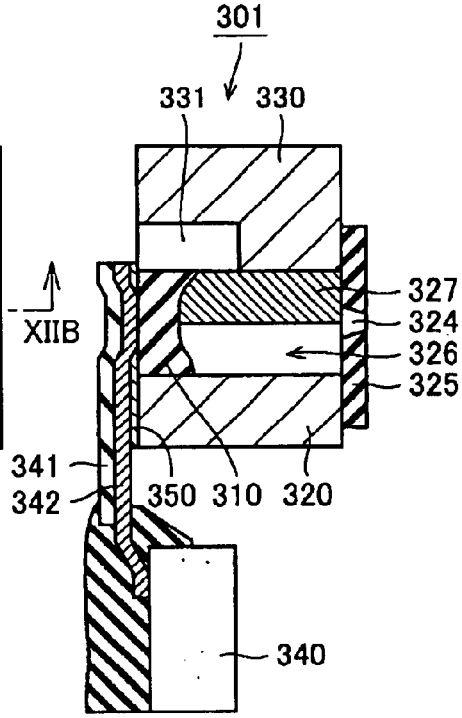
Figure 12B:
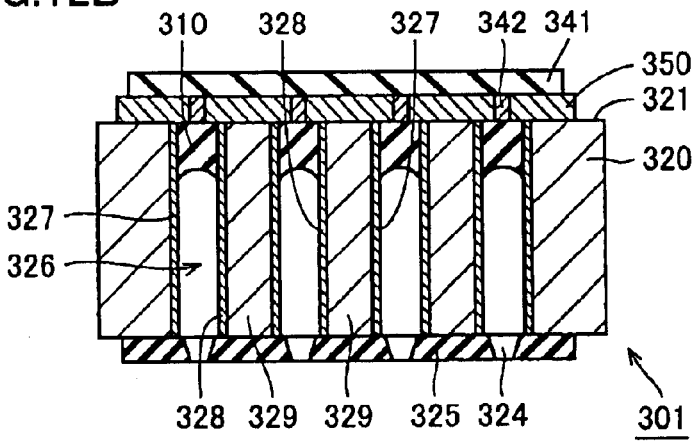

Referring to FIGS. 12A, 12B and 12C an ink jet head 301 of the third embodiment has a plurality of trench-like ink chambers 326 provided at an actuator (substrate) 320 formed of a PZT piezoelectric element. A conductive resin 310 including an Ag conductive filler is provided at respective back side portions 321 of the plurality of ink chambers 326. Conductive resin 310 is exposed at the back side of ink chamber 326.

Each ink chamber 329 formed between a pair of partition wall 329 has a constant cross sectional configuration over the entire length in the longitudinal direction which is the ink discharge direction. Electrodes 327 and 328 are formed at the upper half on the side plane of partition wall 329 facing each other. Electrodes 327 and 328 facing each other are connected to an outer lead 342 of a drive IC 340 in an electrically conducting state via conductive resin 310. At the front side of actuator 320, a nozzle plate 325 having a plurality of nozzle holes 324 corresponding to respective ink chambers 326 is attached. At the top plane of actuator 320, a cover plate 330 forming an ink supply portion 331 above ink chamber 326 is attached. Ink supply portion 331 has an opening at the side of back surface portion 321.

By applying a drive voltage of the same level from drive IC 340 to electrodes 327 and 328 in ink chambers 326 formed in an array at actuator 320 via conductive resin 310 and outer lead 342 as well as applying a voltage of an opposite phase to electrodes 328 and 327 at an adjacent ink chamber 326 with partition wall 329 therebetween, partition wall 329 is shear-deformed to control the ink pressure in ink chamber 326, whereby the ink in ink chamber 326 is discharged from outer lead 342 to front surface side.

Electrical connection between conductive resin 310 and drive IC 340 is established via a TAB tape 341 that holds outer lead 342 corresponding to each ink channel 326 independently.

By inserting an ACF (anisotropic conductive film) 350 at the gap between the back side of actuator 320 and TAB tape 341, sufficient mechanical strength can be provided at the electrical connection between conductive resin 310 and outer lead 342.

An Au plated bump, an Au transfer bump or an Au ball bump can be formed at the surface of outer lead 342 to insert the bump into conductive resin 310 for conduction. Accordingly, the contacting area between conductive resin 310 and outer lead 342 can be increased to achieve a stable electrically connected state.

The connection terminal formed at drive IC 340 can be connected directly to conductive resin 310. In this case, the connection terminal can be inserted into conductive resin 310. Accordingly, the bare chip forming drive IC 340 is mounted on actuator 320 to allow reduction in the size and weight of ink jet head 301. The conduction of the heat generated at drive IC 340 to actuator 320 including the ink allows drive IC 340 to be cooled.

Figure 13A:
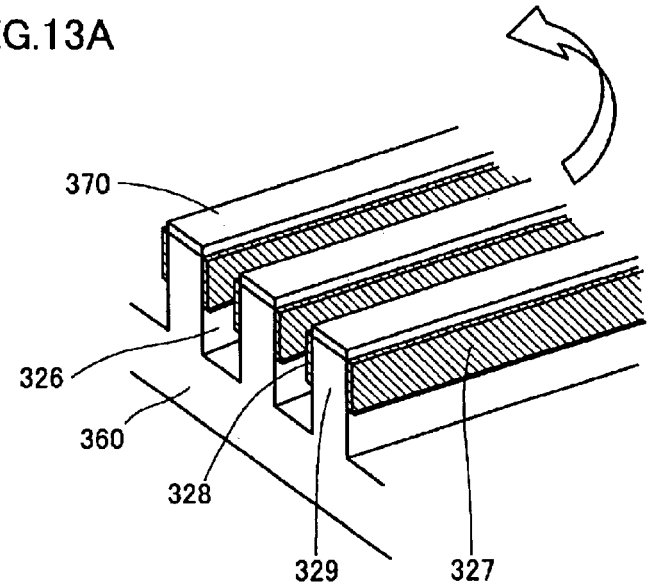
FIGS. 13A, 13B and 13C are diagrams to describe the main part of a fabrication method of the ink jet head according to the third embodiment.
Figure 13B:
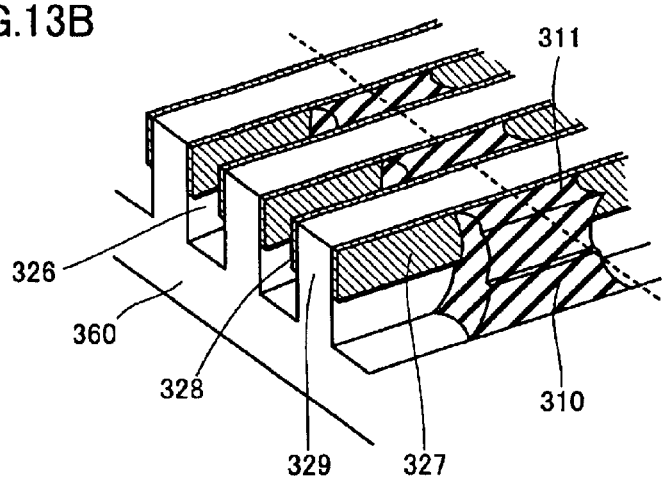

The method of the fabricating the present ink jet head will be described hereinafter with reference to FIGS. 13A, 13B and 13C. In the fabrication process of ink jet head 301 shown in FIGS. 12A, 12B and 12C, a dry film resist 370 is laminated and cured at the surface of a channel wafer 360 formed of a piezoelectric element polarized in the thickness direction. Then, channel wafer 360 is half-diced at a predetermined pitch using a dicing blade of a dicer. As shown in FIG. 13A, a plurality of trench portions corresponding to ink chamber 326 can be formed. Here, the dicing width of the dicing blade should be larger than the diameter of the conductive filler included in conductive resin 310 that is filled afterwards. In the case where a conductive resin 310 including a conductive filler of 0.1 $\mu$m–70 $\mu$m in diameter is employed, the dicing width is at least 70 $\mu$m.

Then, metal corresponding to the electrode materials such as Al or Cu is deposited in a direction orthogonal to the longitudinal direction of each trench portion obliquely from above at respective sides of channel wafer 360. Dry film resist 370 is lift off. Accordingly, electrodes 327 and 328 electrically isolated between each trench portion are formed at the upper half of the two side planes facing each other in each trench portion by the shadowing effect of dry film resist 370 and partition wall 329 located between each trench portion.

Then, a conductive resin 310 in a liquid state (uncured) is applied using a dispenser or the like in the width of 0.5 mm for example, in a direction orthogonal to the longitudinal direction of the trench portion from above channel wafer 360, whereby conductive resin 310 is deposited at the inner side of the trench portion and on partition wall 329. Then, as shown in FIG. 13B, a rubber squeegee is used to shift conductive resin 310 at the top plane of ink chamber 329 into the trench portion and remove any excessive conductive resin 310. Then, conductive resin 310 is cured by applying heat.

For the electrical isolation between each trench portion, conductive resin 310 is to be supplied only inside the trench portion. A nozzle of high precision can be realized if the formation pitch of a trench portion is approximately 200 $\mu$m.

The portion corresponding to the active region of ink chamber 326 in channel wafer 360 can be cooled or conductive resin 310 cured by leaving channel wafer 360 at room temperature taking account of the effect caused by the heat load of the actuator during the heating process of conductive resin 310.

Then, a cover wafer 361 having an ink supply portion 331 formed by counterbore is attached on channel wafer 360 using an adhesive. This cover wafer 361 constitutes cover plate 330 in ink jet head 301. In general, cover wafer 361 is formed of a piezoelectric material which is the material identical to that of the channel wafer where ink jet chamber 326 is formed in order to improve the matching of the coefficient of thermal expansion of the actuator forming ink chamber 326. However, there are cases where an alumina ceramic is employed for the sake of reducing the cost. In such a case, the portion where conductive resin 310 is provided in channel wafer 360 is positioned so as to face the center of ink supply portion 331, as shown in FIG. 13C.

Figure 13C:
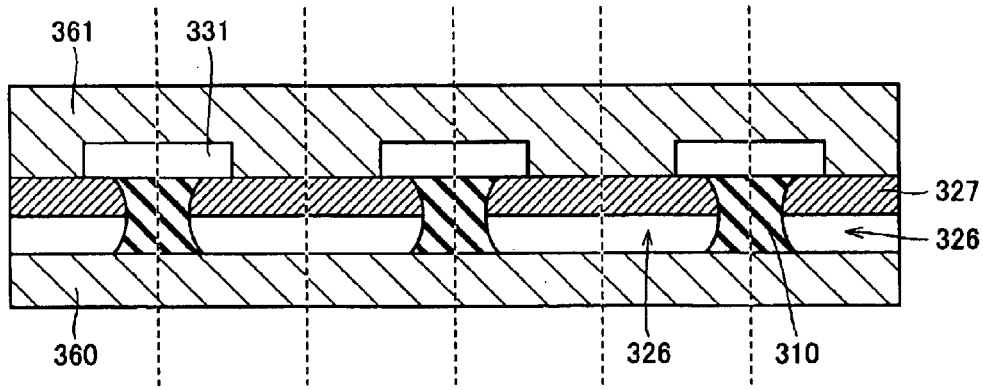

Then, dicing is effected using a dicing blade at the position indicated by the broken line in FIG. 13C to divide the wafer into individual actuators. At one cut plane of each actuator, conductive resin 310 occluding the other end plane of ink chamber 326 is exposed. Ink supply opening 331 is formed. The connection terminal of drive IC 340 is electrically connected to conductive resin 310 to complete an actuator.

Solder can be applied at a predetermined position of each trench portion forming ink chamber 326 instead of conductive resin 310. In the case where solder is employed, the mechanical connection with the electrode conducting with drive IC 340 and the electrical conductivity is superior than the case where conductive resin 310 is used. A connected state of higher reliability can be achieved. Also, variation in the electrical resistance between ink chambers 326 is small. In this case, solder paste which is a mixture of flux and solder particles can be supplied by a dispenser or the like to be first fused by local heating through laser beam radiation and then rendered solid, whereby the heat load to the portion corresponding to the active region of the actuator can be reduced. Depolarization at the active region caused by heat load can be reliably prevented by cooling down the portion corresponding to the active region of channel wafer 360.

In ink jet head 301 employing an electrode connection structure of the present embodiment, the electrode for electrical connection with drive IC 340 which is the external drive circuit is formed by conductive resin 310 applied at the other end plane of ink chamber 326 in the ink discharge direction. Therefore, the structure of drawing the electrode inside the ink chamber out from the ink chamber as in the conventional case is dispensable. The portion other than the active region of ink chamber 326 in the ink discharge direction of actuator 320 is substantially not required. Therefore, the material cost can be reduced. Also, the electrical capacitance is reduced by the reduction of the volume of actuator 320. The frequency of the signal applied to drive the electrode can be increased to allow high speed printing. Furthermore, since the driving voltage can be reduced at the same frequency, the running cost can be minimized. Also, the breakdown characteristic of drive IC 340 can be suppressed to a low level. The cost of drive IC 340 can be reduced.

Conventionally, since the plurality of independent electrodes facing each other in the ink chamber in an actuator that has the partition wall shear-deformed by the shear mode drive must be integrated to a single drive circuit to apply the voltage, the plurality of electrodes for each ink chamber were integrated into one and extended on a planar mounting region on the actuator. In contrast, in the fabrication method of the present embodiment, the plurality of electrodes in ink chamber 326 can be integrated by conductive resin 310 or the solder applied in ink chamber 326. Furthermore, it is to be noted that the cut plane of conductive resin 310 or the solder cut at the time of dicing actuator 320 from the channel wafer, or the planar portion exposed at the surface becomes the connection portion with an external drive IC 340. It is therefore not necessary to form a mounting region other than the active region at actuator 320. Thus, the fabrication process can be simplified.

The electrode for electrical connection in actuator 320 is formed of conductive resin 310 or solder including Au, Ag, Ni and Cu as the conductive filler material or carbon as the conductive filler. In the case where Au or Ag is employed as the conductive filler, the electrical resistance of conductive resin 310 and the connection resistance with the electrode conducting with drive IC 340 can be suppressed to a low level. Therefore, the waveform of the applied voltage to drive actuator 320 will not be dampened. The drive frequency can be improved to allow high speed printing. In the case where Ni or Cu is used as the conductive filler, the cost of conductive resin 310 can be reduced. An economic actuator 320 can be provided. In the case where solder is employed, electrical connection with the electrode conducting with drive IC 340 is established by the metal diffusion bonding of the fused solder. Therefore, reliability of the connected state can be improved. Also, the connection resistance can be reduced.

By using a conductive filler of a needle shape, flake shape or a star fruit shape of conductive resin 310 constituting the electrode for external connection in actuator 320, the oxide film formed at the surface during the formation of electrodes 327 and 328 in ink chamber 326 with Al or the like as the base material can be broken by the conductive filler abutting against the surface of electrodes 327 and 328 in the step of applying conductive resin 310. Accordingly, the connection resistance between conductive resin 310 and electrodes 327 and 328 can be reduced. Dampening of the waveform of the applied voltage to drive actuator 320 can be prevented. The driving frequency can be improved to allow high speed printing.

By selecting a substantially sphere configuration for the conductive filler of conductive resin 310 forming the electrode for external connection in actuator 320, the density of the conductive filler in conductive resin 310 can be maximized. Accordingly, the exposed amount of the conductive filler per unit area at the cut plane of conductive resin 310 cut when actuator 320 is diced from channel wafer 360 is maximized. As a result, the connection resistance between conductive resin 310 and the electrode conducting with drive IC 340 can be reduced to prevent the waveform of the applied voltage to drive actuator 320 from being dampened. The driving frequency can be improved to allow high speed printing.

By setting the longitudinal dimension of the conductive filler included in conductive resin 310 smaller than the width of ink chamber 326 in a direction orthogonal to the ink discharge direction, ink chamber 326 can be reliably filled with the conductive filler. Thus, the yield of ink jet head 301 can be improved.

It is desirable that the glass transition point of conductive resin 310 is at least 60° C. to provide sufficient reliability to ink jet head 301 in the storage temperature range and specification temperature range.

When the electrode for external connection in actuator 320 is formed of solder, the usage of Sn base solder that is economic and easily available allows the provision of an economic ink jet head 301 to which the electrode connection structure of the embodiment of the present invention is applied.

In general, the solder can easily have its melting point altered by adjusting the type or the amount of the added element. Therefore, the melting point can be easily controlled according to the connection temperature with an external electrode in the fabrication process of an ink jet head 301. Modification in the fabrication step and specification can be easily accommodated. In this case, the melting point of the solder material is preferably at least 80° C. in order to provide position reliability to ink jet head 301 at the storage temperature range and specification temperature range.

It is desirable that the viscosity of conductive resin 310 prior to curing is 1000–10,000 cps taking account of the workability of application into ink chamber 326. Also, the shearing strength of conductive resin 310 after curing is at least 10 gf/mm$^2$ taking into account the action of the load during the connection process with outer lead 342. Furthermore, it is desirable that the front side of conductive resin 310 in ink chamber 326 has a side cross sectional configuration of a quadratic curve enlarged at the lower area.

Fourth Embodiment

Figure 14A:
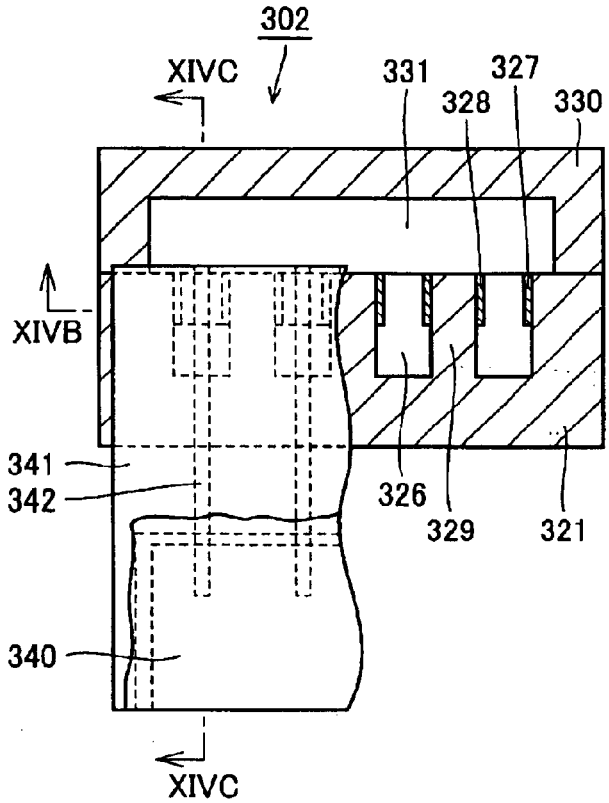
Figure 14C:
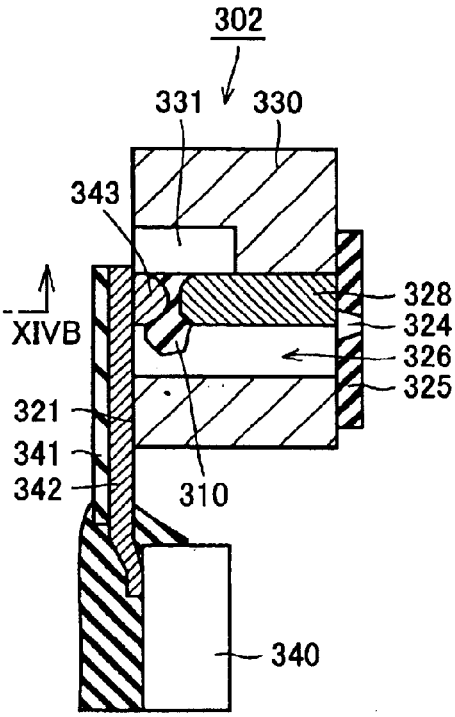
Figure 14B:
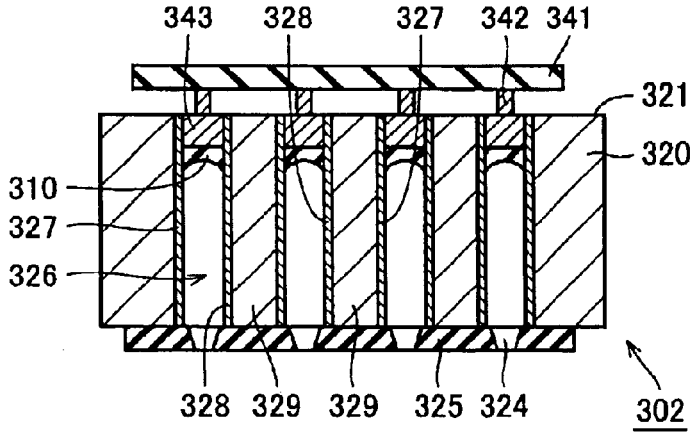
Figure 15:
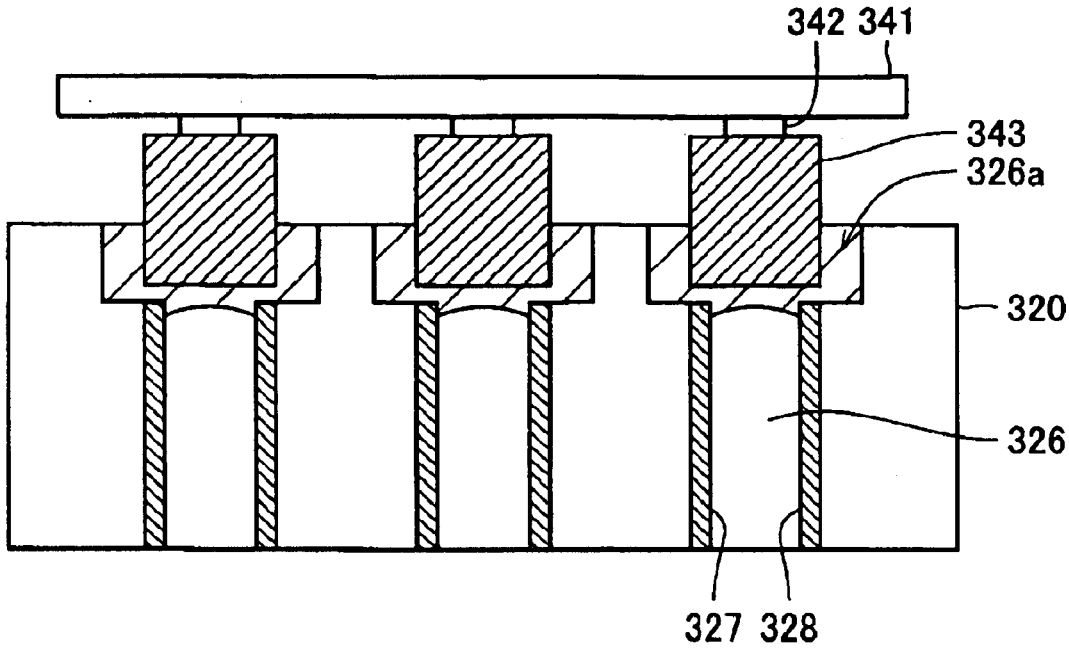
FIG. 15 is a top sectional view showing a structure of the main part of an ink jet head to which another electrode connection structure is supplied according to the fourth embodiment of the present invention.
Figure 16:
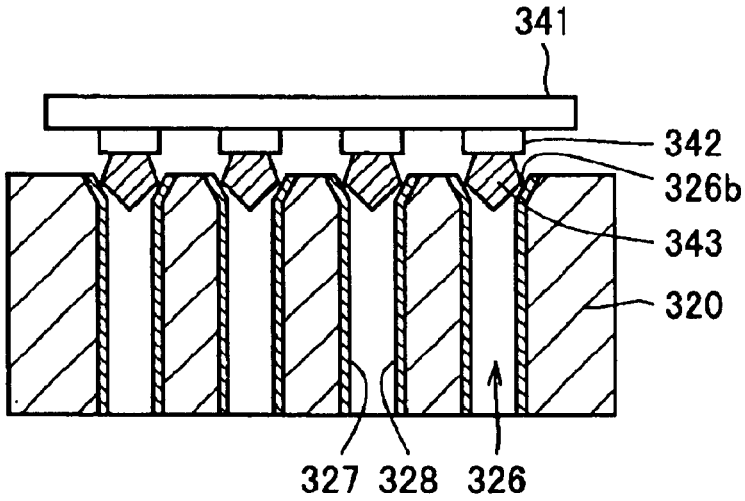
FIG. 16 is a top sectional view showing a structure of the main part of an ink jet head to which still another electrode connection structure is applied according to the fourth embodiment of the present invention.
Figure 17:
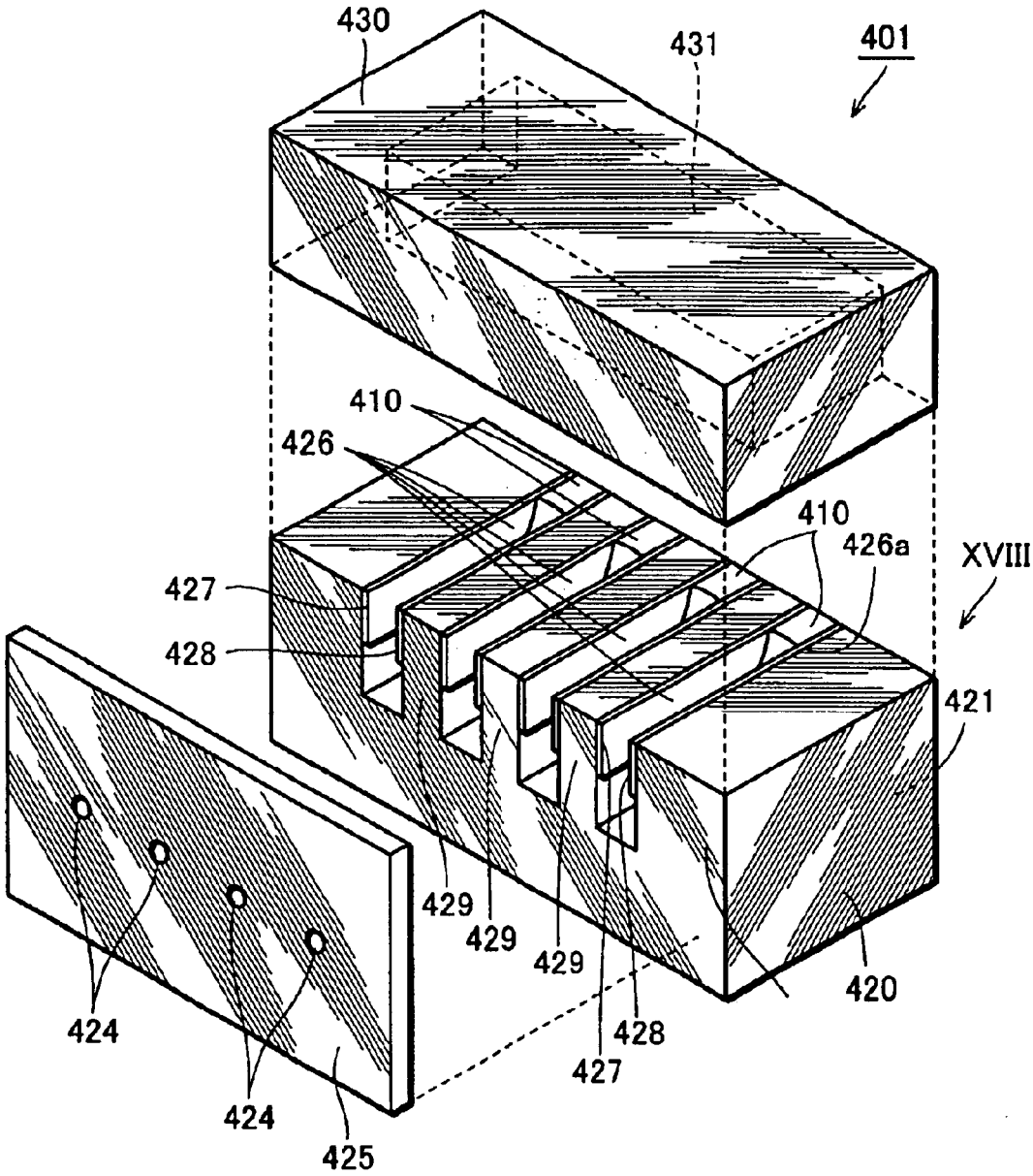
FIG. 17 is an exploded perspective view schematically showing a structure of an ink jet head according to a fifth embodiment of the present invention.
Figure 18A:
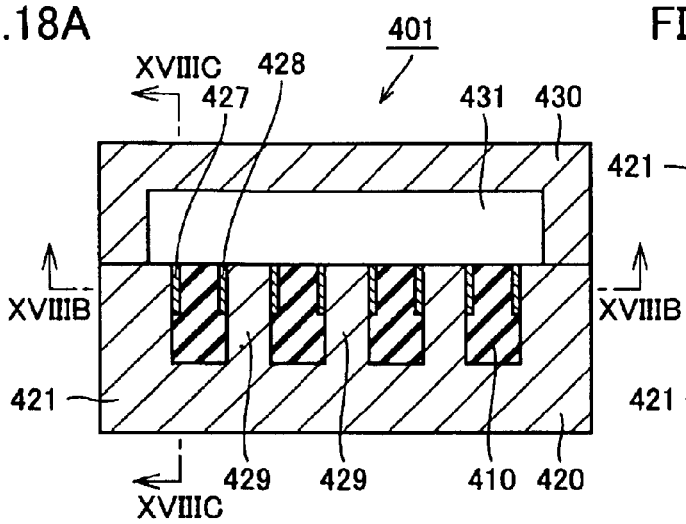
FIG. 18A is an end view of the ink jet head of FIG. 17 viewed from the direction of arrow XVIII.
Figure 18C:
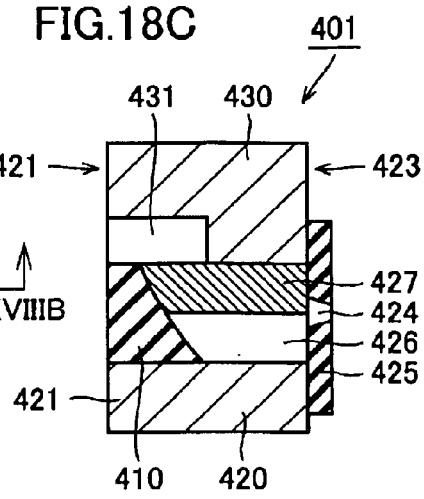
FIGS. 18B and 18C are sectional views taken along lines of XVIIIB—XVIIIB and XVIIIC—XVIIIC, respectively, of FIG. 18A.
Figure 18B:
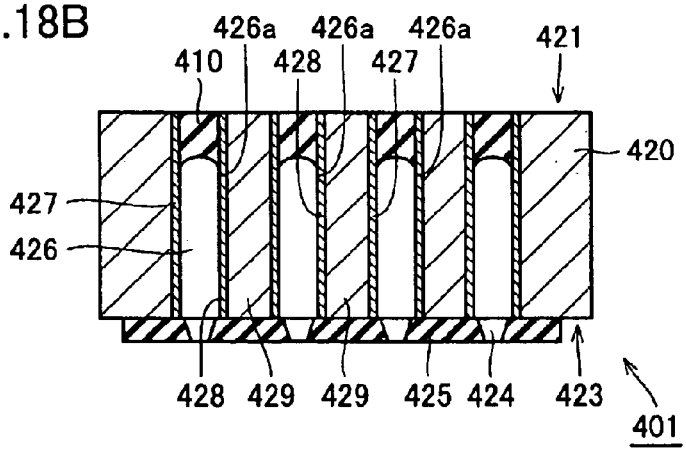

Referring to FIGS. 14A, 14B and 14C, an ink jet head 302 according to a fourth embodiment of the present invention has electrical connection between electrodes 327 and 328 and drive IC 340 established by inserting to the upstream side end of ink chamber 326 in the ink discharge direction a projection electrode 343 formed at an outer lead 342 of a TAB tape 341 that employs a polyimide film, for example, as the base material. Drive IC 340 is mounted at TAB tape 341.

According to such a structure, it is possible to maintain the mechanical fixture between actuator 320 and TAB tape 341 via projection electrode 343 inserted into ink chamber 326. However, taking into consideration the effect of stress during the drive of actuator 320 or caused by change in the environment, additional fixing measures should be taken. Specifically, the back side of actuator 320 and TAB tape 341 is fixed via an adhesive or the like.

The electrical connection between electrodes 327 and 328 in ink chamber 326 and projection electrode 343 is established by applying a conductive adhesive 344 in advance to each projection electrode 343, inserting projection electrode 343 into ink chamber 326, and then apply heat and pressure to cure conductive adhesive 344.

Alternatively, conductive adhesive 344 transferred to projection electrode 343 can be cured to form a conductive resin bump with projection electrode 343 as the core, and insert the conductive bump into ink chamber 326 under elastic deformation. Accordingly, the drive vibration within the elastic deformation region of the conductive resin bump and the strain caused by change in the environment can be absorbed. Thus, the reliability of the connection between electrodes 327, 328 and drive IC 340 can be improved.

As an alternative to projection electrode 343, outer lead 342 can be inserted directly into ink chamber 326, and then effect Au—Sn eutetic connection between an Sn film, for example, formed at the surface of electrodes 327 and 328 in ink chamber 326 and an Au film formed at the surface of outer lead 342 by the well-known single point bonding. In such a case, Au—Au solid phase diffusion bonding, Au—Al solid phase diffusion bonding or solder bonding can be employed instead of Au—Sn eutetic connection.

Similar to the electrode connection structure according to the third embodiment, electrodes 327 and 328 in ink chamber 326 can employ a vapor deposition film of Al, Cu, Ni and the like. As the material of outer lead 324 including projection electrode 343, the lead material such as Au, Cu, Sn, Ni, Al, or the lead material such as of solder, or the plating material on the lead or the like can be employed. The remaining structure of actuator 320, cover plate 330 and nozzle plate 325 of ink jet head 302 as well as the ink discharge mechanism is similar to those of ink jet head 301 to which an electrode connection structure is applied according to the third embodiment.

By such a structure, electrodes 327 and 328 for electrical connection with drive IC 340 do not have to be formed extending out from the side plane or top plane of actuator 320. A mounting region other than the active region does not have to be formed in actuator 320. Therefore, the cost of the piezoelectric material forming actuator 320 can be reduced. The mass of actuator 320 can be decreased to reduce the electrical capacitance. The driving frequency can be improved to allow high speed print out. Also, the breakdown voltage of drive IC 340 can be reduced by the reduction of the driving voltage. The cost of the components of drive IC 340 and the running cost can be reduced.

Projection electrode 343 at TAB tape 341 can be generally formed using an Au plated bump, a Au wire bump or an Au transfer bump. However, in the case where projection electrode 343 is inserted into ink chamber 326 while abutting against partition wall 329 of actuator 320 to ensure the electrically connected state, a material that facilitates plastic deformation such as the elementary substance of Pt, Pt alloy, the elementary substance of In or In alloy is suitable. Furthermore, by forming projection electrode 343 via a conductive resin bump facilitated in elastic deformation, damage of partition wall 329 in the abutment step can be prevented to improve the yield of the fabrication.

By forming a concave 326*a* by counterbore or the like at the opening of ink chamber 326 at the back side of actuator 320 to increase the width of the opening, the positioning between ink chamber 326 and projection electrode 343 can be facilitated in the step of inserting projection electrode 343 into ink chamber 326 from the back side of actuator 320. In the case where the width of projection electrode 343 in the direction orthogonal to the ink discharge direction substantially matches the width of ink chamber 326, accurate positioning between projection electrode 343 and ink chamber 326 must be effected when projection electrode 343 is inserted into ink chamber 326. Also, the distance and respective width of the plurality of ink chambers 326 formed at actuator 320 and the distance and respective width of the plurality of projection electrodes 343 formed at TAB tape 341 must be strictly defined to the predetermined dimensions. This will render complicated the assembly process of ink jet head 32 and the fabrication of respective components.

In view of the foregoing, concave portion 326*a* is formed at the periphery of each ink chamber 326 while avoiding communication with an adjacent ink chamber 326 at the back plane of actuator 320. This alleviates the critical positioning accuracy between ink chamber 326 and projection electrode 343 and the dimension accuracy of respective components. For example, when the pitch of ink chamber 326 and projection electrode 343 is 20 $\mu$m, the width of ink chamber 326 is 70 $\mu$m and the width of projection electrode 343 is 60 $\mu$m, the tolerance of the position of projection electrode 343 with respect to ink chamber 326 is ±5 $\mu$m when there is no concave 326*a*. In contrast, in a state where concave 326*a* having an opening width of 90 $\mu$m is formed, the tolerance is alleviated to ±10 $\mu$m. It is to be noted that the electrical connection between projection electrode 343 and electrodes 327 and 328 is carried out using a conductive adhesive when projection electrode 343 is inserted into concave 326*a* formed in actuator 320.

The opening area of ink chamber 326 can also be increased by forming a tapered inclining plane 326*b* at the periphery of ink chamber 326 at the back plane of actuator 320. Similar to the case of forming concave 326*a*, the positioning of projection electrode 343 to ink chamber 326 can be facilitated. In other words, even if there is a slight error in the position of projection electrode 343 with respect to ink chamber 326 in the direction orthogonal to the ink discharge direction when projection electrode 343 is inserted into ink chamber 326 from the back plane side of actuator 320, projection electrode 343 will be guided properly into ink chamber 326 by the self alignment effect due to the abutment against inclining plane 326*b*. The product yield can be improved.

Concave 326*a* or inclining plane 326*b* formed at the periphery of ink chamber 326 at the back plane of actuator 320 is the guide portion of the present invention. Electrodes 327 and 328 in ink chamber 326 can be formed continuously at concave 326*a* or inclining plane 326*b*. Therefore, by setting the width of projection electrode 343 in the direction orthogonal to the ink discharge direction within the range of the width of ink chamber 326 and the opening width of concave 326*a*, or within the range of the smallest width and largest width of the distance between two facing inclining planes 326*b*, the electrical connection between projection electrodes 324 and the electrodes 327 and 328 can be ensured at the inner side plane of concave 326*a* or at the middle region of inclining plane 326*b*. In the case where inclining plane 326*b* is employed, the plastic deformation occurring when projection electrode 343 abuts against inclining plane 326*b* allows a larger contacting area between projection electrode 343 and electrodes 327 and 328. Therefore, the electrical connection therebetween can be further improved.

By forming projection electrode 343 using Au, In, or Pt that easily exhibits plastic deformation or a conductive resin bump that easily exhibits elastic deformation, the abutment against the peripheral portion of ink chamber 326 during the insertion into ink chamber 326 allows projection electrode 343 to be plastic-deformed or elastic-deformed. Therefore, by forming at least some of projection electrodes 343 wider than the width of ink chamber 326 in the direction orthogonal to the ink discharge direction, the electrical connection between electrodes 327 and 328 located in ink chamber 326 and projection electrode 343 can be ensured.

According to the above-described structure, electrical connection between electrodes 327 and 328 in ink chamber 326 and drive IC 340 is effected by inserting projection electrode 343 formed on outer lead 342 of TAB tape 341 into ink chamber 326. Therefore, drive IC 340 can be supplied as a TAB device mounted on TAB tape 341 during the fabrication of ink jet head 302. Accordingly, reduction in the size and cost of drive IC 340 can be realized since an IC corresponding to a TAB device can have the pad pitch readily reduced. Also, drive IC 340 corresponding to a TAB device can be conveyed in the reel-to-reel scheme to improve the productivity of ink jet head 302.

By virtue of the structure of inserting projection electrode 343 into ink chamber 326, drive IC 340 can be attached to actuator 320 in a bare chip state. Therefore, the weight of ink jet head 302 can be reduced. By bringing drive IC 340 into contact with actuator 320 that stores ink during usage, the heat generated by drive IC 340 can be conducted to actuator 320 storing ink to improve the heat discharge efficiency. Therefore, the driving IC can be operated stably.

By electrically connecting projection electrode 343 with electrodes 327 and 328 in ink chamber 326 via a conductive adhesive, the strain of ink chamber 326 can be absorbed by the elastic deformation of the conductive adhesive even when vibration occurs at ink chamber 326 during the drive or when heat stress is applied on ink chamber 326. The reliability of the electrical connected state between projection electrode 343 and electrodes 327 and 328 can be improved. In this case, the area of the cross section of projection electrode 343 in the direction orthogonal to the ink discharge direction can be set smaller than the area of the cross section of ink chamber 326. Partition wall 329 will not be damaged by the abutment of projection electrode 343 inserted into ink chamber 326. Therefore, the product yield can be improved.

The usage of an anisotropic conductive adhesive for the electrical connection between projection electrode 343 and electrodes 327 and 328 in ink chamber 326 is also advantageous in that, by applying the an isotropic conductive adhesive at the back plane of actuator 320 including the side plane of partition wall 329 in ink chamber 326, the electrical connection between electrodes 327 and 328 and projection electrode 343 and the mechanical fixture between actuator 320 and TAB tape 341 or drive IC 340 formed with projection electrode 343 can be effected at the same time. Therefore, the fabrication process is simplified.

Also, the usage of metal diffusion bonding for the electrical connection between electrodes 327 and 328 in ink chamber 326 and projection electrode 343 at TAB tape 341 provides the advantage that the connection resistance between electrodes 327 and 328 and projection electrode 343 can be reduced to prevent dampening of the waveform of the voltage applied during driving. The driving frequency can be improved to allow high speed printing.

By using a material that readily exhibits plastic deformation or elastic deformation for at least the portion of projection electrode 343 that abuts against ink chamber 326 during the insertion thereto, damage of partition wall 329 caused by abutment of projection electrode 343 can be prevented. Furthermore, the electrical connection between electrodes 327 and 328 and projection electrode 343 can be ensured.

In order to prevent ink leakage, the upstream side end of ink chamber 326 in the ink discharge direction must be completely occluded at the back plane of actuator 320. To this end, a resin for sealing or an ACF can be applied between actuator 320 and TAB tape 341 after projection electrode 343 is inserted into ink chamber 326.

Fifth Embodiment

Referring to FIGS. 17, 18A, 18B and 18C, an ink jet head 401 according to a fifth embodiment of the present invention mainly includes an actuator (substrate) 420, a plurality of electrodes 427 and 428 to drive the actuator, an insulative resin 410, a cover member 430, and a nozzle plate 425.

Actuator 420 is formed of a piezoelectric element such as of PZT. Actuator 420 has a plurality of ink chamber trenches 426*a* arranged in an array, wherein each ink chamber trench 426*a* penetrates from an ejection plane 423 to a trailing end plane 421. At respective regions in actuator 420, a partition wall 429 sandwiched between the plurality of ink chamber trenches 426*a* is formed. Inside ink chamber trench 426*a*, two electrodes to drive the actuator (inside electrode) 427 and 428 are formed at the inner wall plane of partition wall 429 so as to face each other.

Each of electrodes 427 and 428 are formed at the upper half of partition wall 429. Each of electrodes 427 and 428 is formed of, for example, a Cu (copper) thin film of 0.5 $\mu$m in thickness. The end plane of electrodes 427 and 428 in the longitudinal direction is exposed at trailing end plane 421. Since the width of the exposed end plane is set to have a thickness of 0.5 $\mu$m and a length of 140 $\mu$m, the area of that end plane is $7\times10^{-5}$ mm$^2$. The area of the end plane exposed at trailing end plane 421 of electrodes 427 and 428 is preferably at least $7\times10^{-5}$ mm$^2$.

Insulative resin 410 includes, for example, a silica filler, and is filled in ink chamber trench 426*a* so as to occlude the side of ink chamber trench 426*a* at trailing end plane 421. The portion in ink chamber trench 426*a* excluding electrodes 427 and 428 and insulative resin 410 functions as ink chamber 426. Insulative resin 410 prevents ink from flowing from ink chamber 426 towards trailing end plane 421. Insulative resin 410 preferably has the property of either an elastic modulus of 10 GPa under an environment of 100° C. or below or a coefficient of linear expansion of not more than 50 ppm/° C. under an environment of 100° C. or below.

A nozzle plate 425 with small nozzles 424 is attached at ink ejection plane 423 of actuator 420. At the top plane of actuator 420, a cover member 430 is attached so that ink supply opening 431 is located above ink chamber 426. Ink supply opening 431 is open at trailing end plane 421.

In the operation of ejecting ink droplets from ink jet head 401, a voltage of the same potential is applied to the two electrodes 427 and 428 located within the same ink chamber trench 426*a*, and a voltage of the opposite phase is applied to the two opposite electrodes 428 and 427 with partition wall 429 therebetween. Accordingly, partition wall 429 functions as an actuator to drive in a shear mode. By controlling the ink pressure within ink chamber 426, small droplets of ink is discharged from nozzle 424.

Figure 19A:
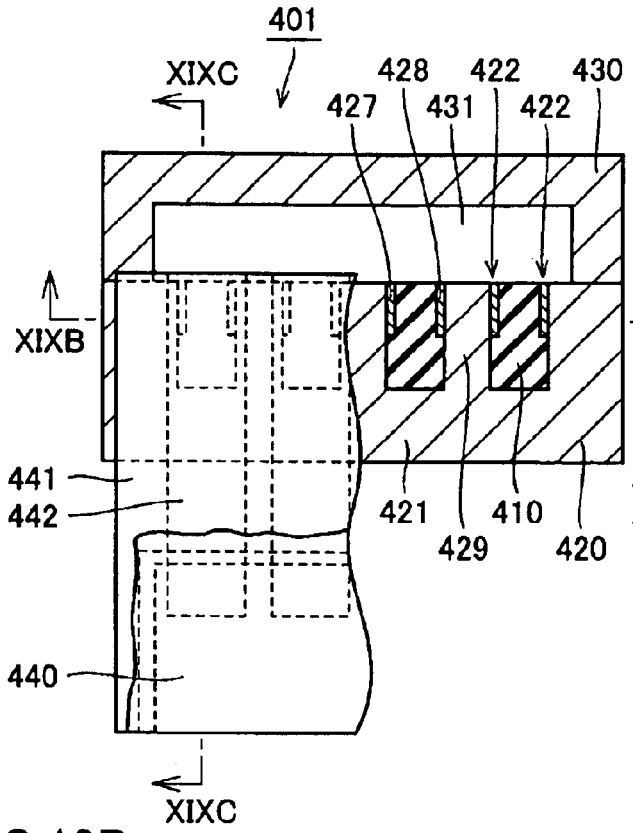
FIG. 19A is an end view showing the ink jet head of FIG. 17 connected to an external drive circuit, viewed from the direction of XVIII of FIG. 17, and FIGS. 19B and 19C are sectional views taken along lines XIXB—XIXB and XIXC—XIXC, respectively, of FIG. 19A.
Figure 19C:
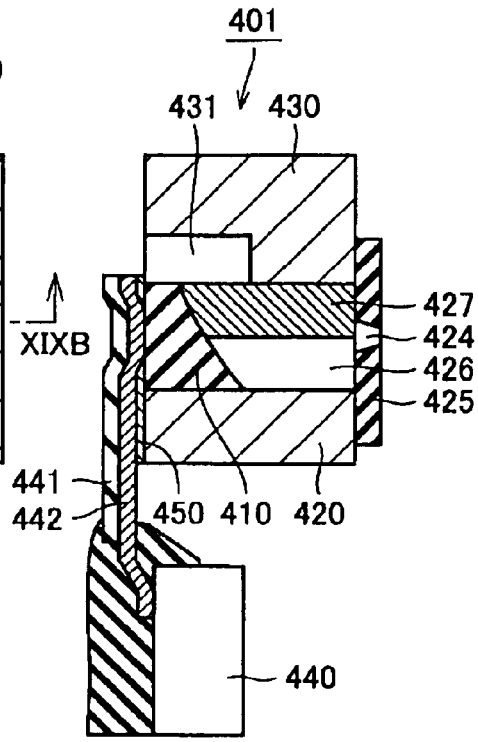
Figure 19B:
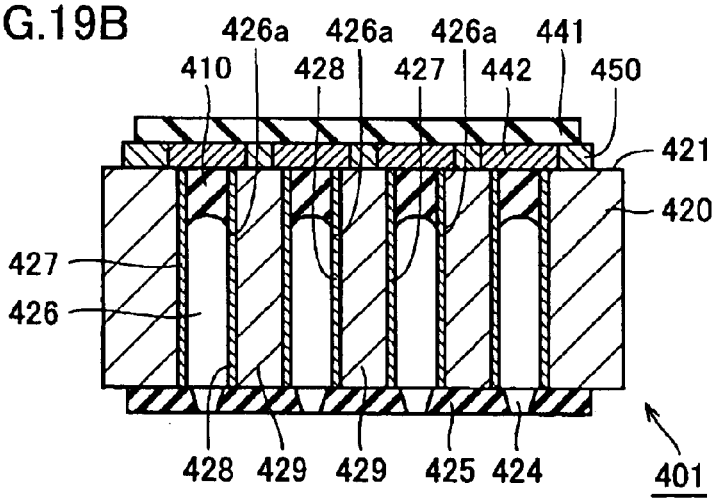

Electrodes 427 and 428 of ink jet head 401 of the present embodiment has drive IC 440 electrically connected, as shown in FIGS. 19A, 19B and 19C. Specifically, an outer lead 442 of TAB tape 441 conducting with drive IC 440 is electrically connected via an ACF 450 to each end plane of electrodes 427 and 428 exposed at trailing end plane 421. By such a connection, outer lead 442 is electrically connected intensively to both electrodes 427 and 428 of outer lead 442. According to this connection, an Ni (nickel) conductive particle of ACF 450 is present between the end planes of electrodes 427 and 428 and outer lead 442. By curing the resin component of ACF 450, outer lead 442 can be mechanically connected to ink jet head 401.

In this connection, the area of each end plane of electrodes 427 and 428 exposing from trailing end plane 421 is designed to $7\times10^{-5}$ $mm^2$, as described above. Therefore, sufficient stability and reliability in connection can be ensured.

Additionally, Au plating can be applied on the end plane of electrodes 427 and 428 exposing from trailing end plane 421 to reduce the connection resistance with outer lead 442. In this case, the dampening of the driving pulse and the heat generated by the resistance component can be reduced. Also, electrical connection with an external drive circuit can be effected by expose plane 422 of electrodes 427 and 428 above ink chamber similarly to that described above. Here, insulative resin 410 may be a conductive resin including, for example, an Ag (silver) filler. In this case, electrodes 427and 428 in the same ink chamber 426 can be electrically connected by conductive resin 410.

Since the cross sectional area of the conductive particle of conductive resin 410 is included as the electrode area effective for connection with outer lead 442 at the cut plane, electrodes 427 and 428 can be made further thinner to allow improvement in productivity. Also, the material of a low coefficient of linear expansion such as a silica filler and carbon particles can be dispersed in conductive resin 410 to approximate the coefficient of linear expansion of the PZT which is the material of actuator 420. By meeting the coefficient of linear expansion of conductive resin 410 in ink chamber trench 426*a* and PZT, the reliability of resistance to heat stress can be improved.

A method of fabricating the above-described ink jet head of the present embodiment is set forth below.

Figure 20:
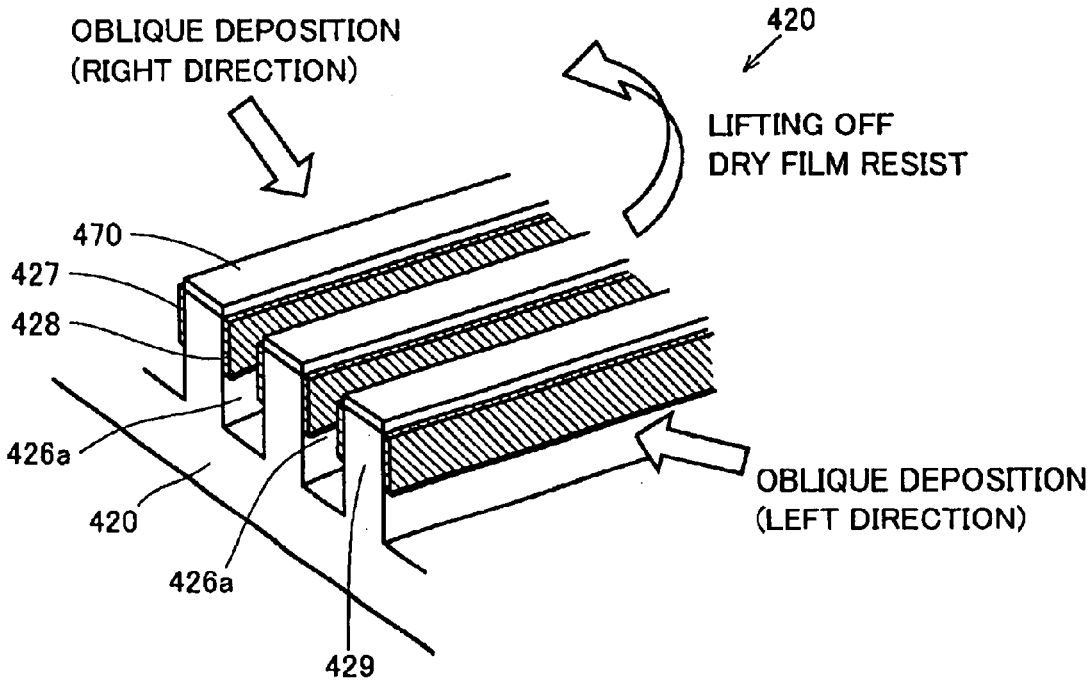
FIGS. 20, 21 and 22 are sectional views of the ink jet head of the fifth embodiment corresponding to a first step, a second step, and a third step, respectively, of a fabrication method thereof.

Referring to FIG. 20, a dry film resist 470 is laminated and cured at one surface of a piezoelectric element wafer (channel wafer) 420 polarized in the direction of the thickness. Channel wafer 420 is half-diced using a dicing blade of a dicer to form an ink chamber trench 426*a*.

Following formation of a plurality of ink chamber trenches 426*a* (ink chamber array), metal corresponding to the electrode material such as Al or Cu is deposited obliquely from a direction perpendicular to the longitudinal direction of ink chamber trench 426*a*. By carrying out this process from the left direction and right direction to the longitudinal direction of ink chamber trench 426*a*, metal electrodes 427 and 428 are formed at the surface of partition wall 429. Metal electrodes 427 and 428 are formed to approximately half the depth of ink chamber trench 426*a* by the shadowing effect of dry film resist 470 and each partition wall 429.

Then, dry film resist 470 is lifted off. Electrical isolation between each ink chamber trench 426*a* is ensured without formation of an electrode at the top plane of partition wall 429.

Figure 21:
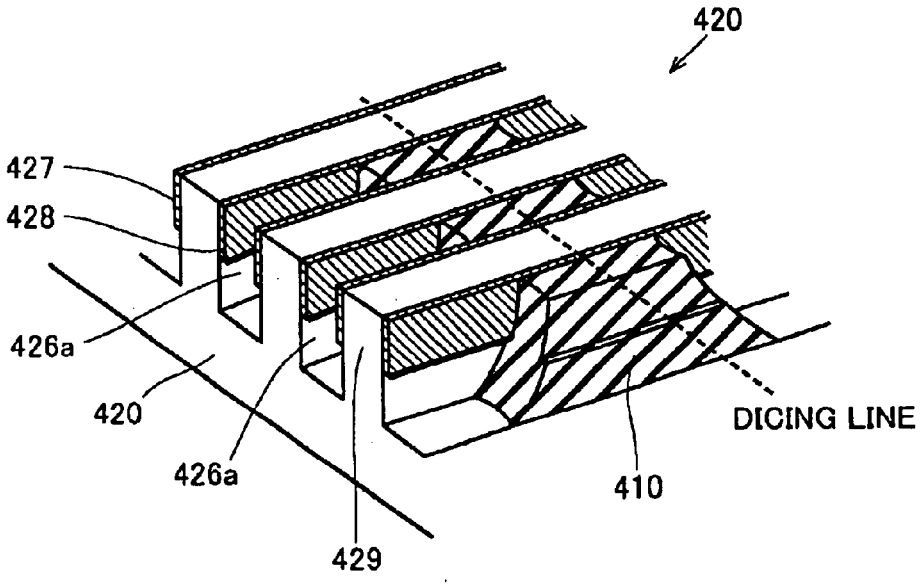

Referring to FIG. 21, a liquid insulative resin 410 is applied at a width of 1 mm in a straight manner on ink chamber trench 426*a* and partition wall 429 using a dispenser or the like in a direction orthogonal to the ink chamber array (the direction orthogonal to the longitudinal direction of ink chamber trench 426*a*). By setting the viscosity of insulative resin 410 to not more than 10000 cps, ink chamber trench 426*a* is easily filled with insulative resin 410. If the viscosity is at most 1,000,000 cps, the viscosity will further become lower as a function of the temperature rise in the curing step so that ink chamber trench 426*a* will be filled prior to the curing reaction. Therefore, a sealing material that is at most 1,000,000 cps can be substantially used as insulative resin 410.

Then, insulative resin 410 is cured by being left for one hour in an oven of 100° C. Alternatively, the resin curing process may be carried out on a hot plate. In this case, a Peltier element or a coolant is circulated in the hot plate to allow local cooling so that the active area portion of actuator 420 is cooled. By forcing the active area to be cooled, damage caused by heat to actuator 420 can be reduced. Instead of curing by heating, insulative resin 410 can be cured by being left at room temperature.

Insulative resin 410 attached on partition wall 429 is ground away using a lapping film of number 600 and 1200. Accordingly, the planarity of channel wave 420 and the cover wafer (not shown) can be ensured during the subsequent wafer bonding process to allow favorable wafer bonding.

Figure 22:
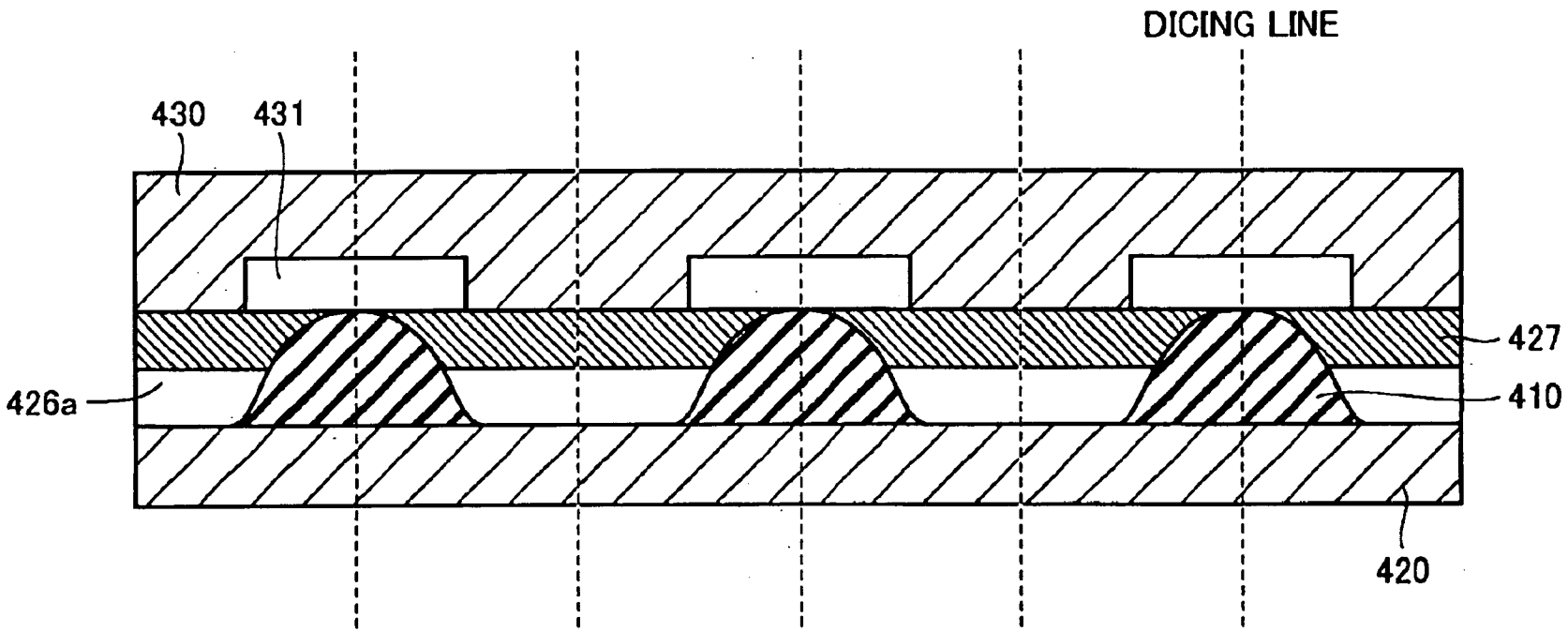
Figure 23:
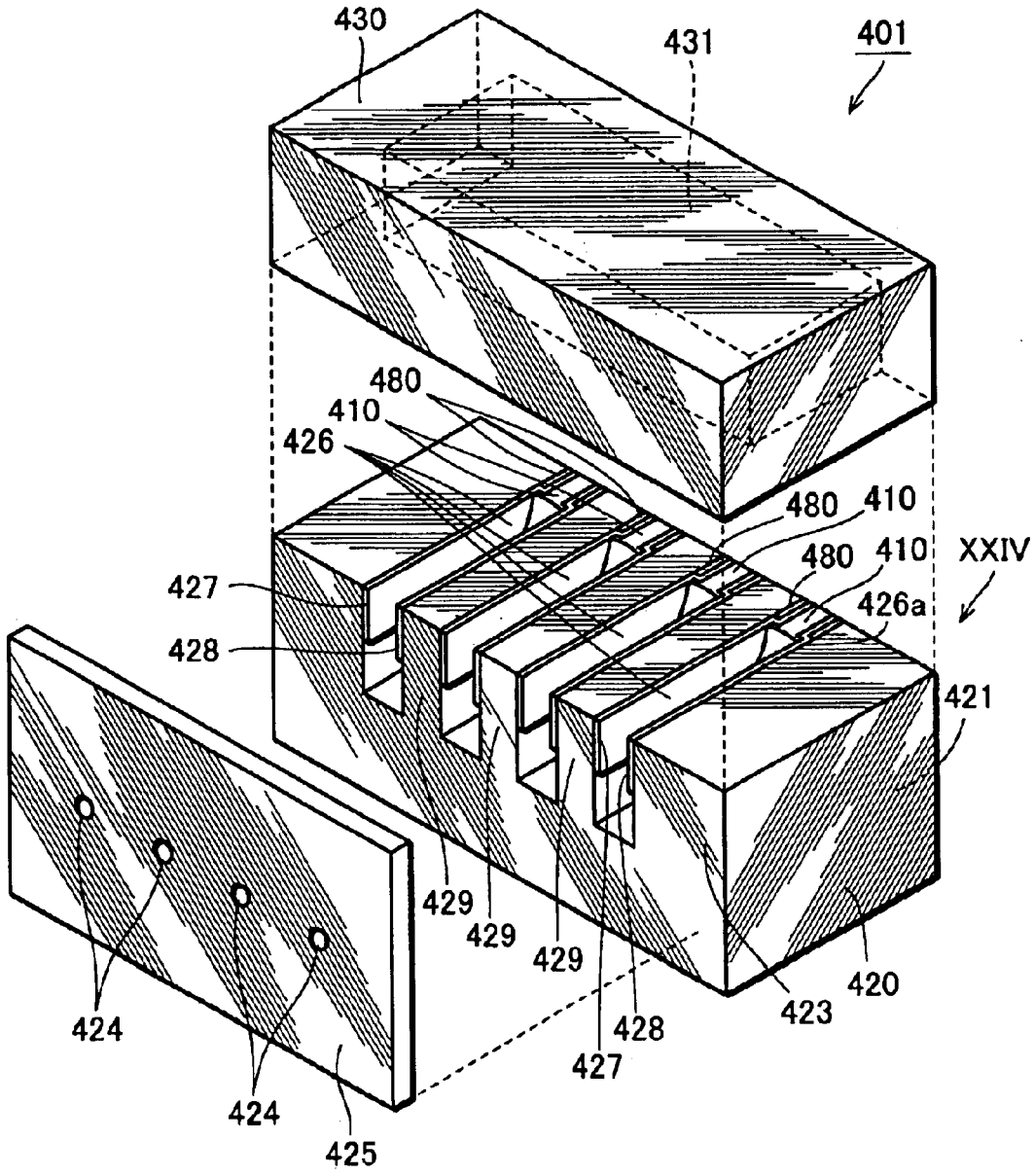
FIG. 23 is an exploded perspective view of an ink jet head according to a sixth embodiment of the present invention.
Figure 24A:
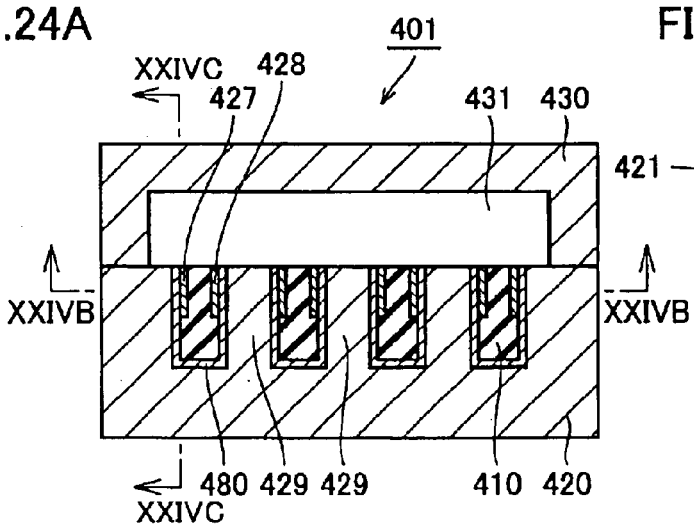
FIG. 24A is an end view of the ink jet head of FIG. 23 viewed from the direction of arrow XXIV.
Figure 24C:
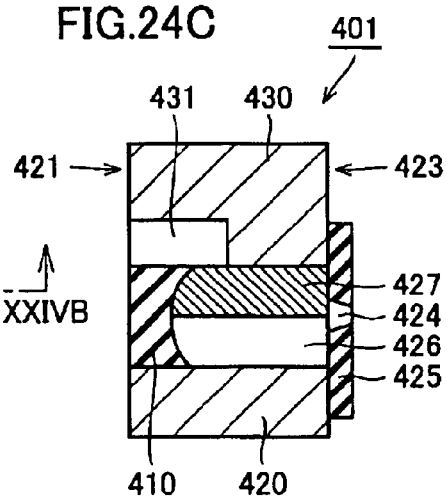
FIGS. 24B and 24C are sectional views taken along lines XXIVB—XXIVB and XXIVC—XXIVC, respectively, of FIG. 24A.
Figure 24B:
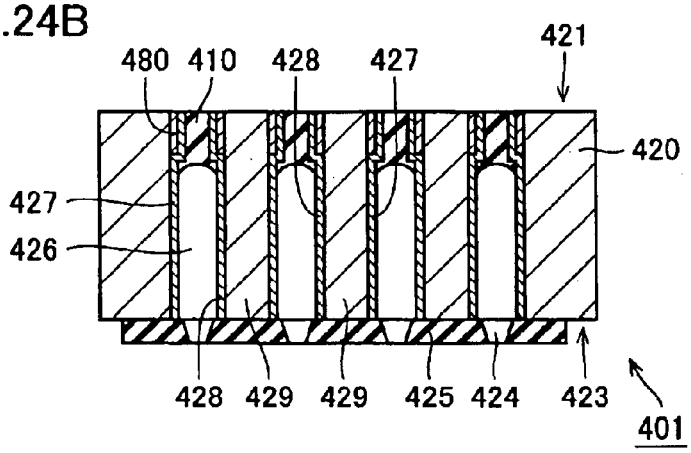

Referring to FIG. 22, a cover wafer 430 formed of a piezoelectric element having the counterbore for ink supply opening 431 formed is prepared. Cover wafer 430 forms ink supply opening 431 when assembled into ink jet head 401, and becomes the cover member to close the top of ink chamber 426. In general, the material of cover wafer 430 is identical to that of piezoelectric element forming actuator 420 in order to match the coefficient of thermal expansion with actuator 420. However, the economic alumina ceramic with a relatively close coefficient of thermal expansion can be used.

Wafer 420 having an ink chamber array formed and cover wafer 430 are attached with a commercially-available adhesive. Here, the portion where insulative resin 410 is filled is positioned so as to correspond to the center of the counterbore portion for ink supply opening 431 of cover wafer 430. Then, channel wafer 420 and cover wafer 430 are cut (into small pieces) by the dicing blade of a dicer at the counterbore portion for ink supply opening 431 and the applied portion of insulative resin 410 along the dicing line indicated by the broken line.

Here, insulative resin 410 and electrodes 427 and 428 are exposed at the cutting plane. In the electrical connection with an external circuit conducting with the drive IC that is connected subsequently, the electrode pushing load is received by the entire surface of the external circuit electrode. The pressing force is concentrated locally to prevent damage of the external circuit electrode. At this cut plane, ink supply opening 431 is opened.

Insulative resin 410 is formed of an epoxy type resin having a silica filler dispersed. The coefficient of linear expansion is adjusted to 50 ppm/° C. Therefore, in contrast to an actuator 420 formed of the general epoxy type resin absent of a filler to produce cracks in the resin at the early stage in the temperature cycle testing, an actuator 420 formed of an epoxy type resin with a silica filler dispersed as in the present embodiment exhibits connection reliability.

In the present embodiment, electrodes 427 and 428 are located only in ink chamber groove 426*a*, and their end plane is exposed at trailing end plane 421 of substrate 420. Although the electrode to drive the actuator was conventionally drawn out from the ink chamber for mounting, the electrode does not have to be drawn out in the present embodiment. A portion other than the active area of the actuator is not required. Therefore, the material cost can be reduced. Also, since the driving frequency can be improved by the reduction of the electrical capacitance, high speed printing can be realized. Since the driving voltage can be reduced, the breakdown voltage of the drive IC can be lowered. Thus, the cost of the drive IC and the power consumption for driving can be reduced.

The area of the cross section of each side plane of electrodes 427 and 428 exposed at trailing end plane 421 is at least $7\times10^{-5}$ mm$^2$. Accordingly, the reliability of the electrode connection by an ACA or an NCA is sufficient in the connection with the electrode conducting with the IC that drives the ink jet head carried out subsequently.

Each of electrodes 427 and 428 has a coat of a metal film at the surface. Since electrodes 427 and 428 are used as the electrode for connection with an external drive circuit, the electrode must be made thick enough. The formation of a metal film through a vacuum process such as vapor deposition and sputtering is disadvantageous in productivity since the throughput is slow. However, by forming the seed layer for plating thin by the vacuum process and forming a metal film of the desired thickness by plating, the productivity can be improved. The film quality of the metal film per se is uniform. The internal stress can be alleviated to reduce the defect of metal film peeling. An economic ink jet head stable in quality and high in reliability can be realized.

Filling member 410 includes the material of either a conductive resin or insulative resin. Since a predetermined region in ink chamber trench 426*a* is filled with a conductive resin or insulative resin, the strength of the channel wafer is increased to alleviate damage in the subsequent dicing process into small pieces. The production yield can be improved. Therefore, an economic ink jet head can be realized.

In the case where a conductive resin is employed, the pair of electrodes 427 and 428 for driving the actuator in the same ink chamber trench 426*a* can be electrically connected by the conductive resin. Furthermore, since the cross section plane of the conductive resin can be used as the connection electrode with the external drive circuit, a large connection area can be readily achieved to allow favorable connection stability. In the case where an insulative resin is employed, a filler that has a relatively low coefficient of linear expansion such as a silica filler and alumina filler can be dispersed into the additive of the resin. Therefore, the low coefficient of linear expansion of the piezoelectric element can be easily met. Damage of the piezoelectric element caused by heat stress and the like can be prevented. The environment reliability is improved.

Filling member 410 has at least the property of either an elastic modulus of not more than 10 GPa under an environment of 100° C. or below, or a coefficient of linear expansion of not more than 50 ppm/° C. under an environment of 100° C. or below. Accordingly, the heat stress between the piezoelectric element and the filling member can be alleviated by the elastic deformation of filling member 410 when the elastic modulus of filing member 410 is not more than 10 GPa. When the coefficient of linear expansion of filling member 410 is not more than 50 ppm/° C., the heat stress can be reduced. Therefore, an ink jet head superior in environment reliability can be provided.

Furthermore, the fabrication step can be simplified since it is not necessary to form an actuator 420 of a complicated structure.

A filling member 410 is formed so as to fill a predetermined region between electrodes 427 and 428 facing each other in each of the plurality of ink chamber trenches 426*a*. Channel wafer 420 and cover wafer 430, after being attached, are cut at the position where filling member 410 is cut.

Since filling member 410 formed of a conductive resin or insulative resin is filled in ink chamber trenches 426*a*, the strength of channel wafer 420 is increased to alleviate damage in the subsequent dicing process into small pieces. The production yield is improved to allow an economic ink jet head.

Sixth Embodiment

An ink jet head according to a sixth embodiment of the present invention will be described hereinafter with reference to FIGS. 23, 24A, 24B and 24C. The ink jet head of the present embodiment differs from the ink jet head of the fifth embodiment in that a metal film (conductive layer for connection) 480 is added. Metal film 480 is formed along the inner wall plane of ink chamber trench 426*a*, and so as to have each end plane exposed at trailing end plane 421 of actuator 420. Each of electrodes 427 and 428 are formed so as to run on metal film 480 while forming contact within ink chamber trench 426*a*. The end plane of each of electrodes 427 and 428 is exposed at trailing end plane 421.

Electrodes 427 and 428 are formed of, for example, Al of 0.1 $\mu$m in thickness. Metal film 480 conducting with electrodes 427 and 428 is provided by forming a Cr (chromium) contact layer and Cu seed layer in ink chamber trench 426*a* through sputtering, and then forming an Ni electroless plated layer and a flush Au plated layer of 1 $\mu$m in thickness. Since the end plane of 1 $\mu$m-thick metal film 480 exposed at trailing end plane 421 is formed all over the inner wall of ink chamber trench 426*a* of 280 $\mu$m in depth and 40 $\mu$m in width, the area of the cross section of the exposed plane of metal film 480 is approximately $60\times10^{-5}$ mm$^2$.

The remaining structure is substantially similar to that of the fifth embodiment. The same components have the same reference characters allotted, and description thereof will not be repeated.

Figure 25A:
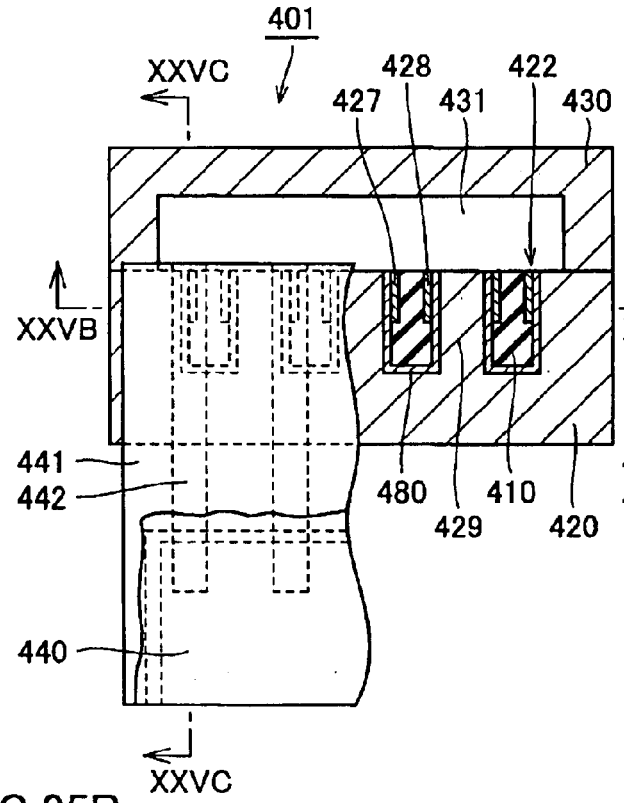
FIG. 25A is an end view of the ink jet head of FIG. 25A connected to an external drive circuit, viewed from the direction of XXIV of FIG. 23, and FIGS. 25B and 25C are sectional views taken along lines XXVB—XXVB and XXVC—XXVC, respectively, of FIG. 25A.
Figure 25C:
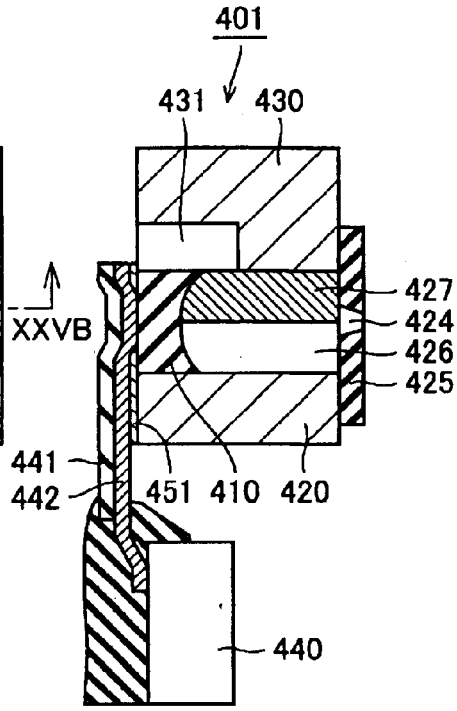
Figure 25B:
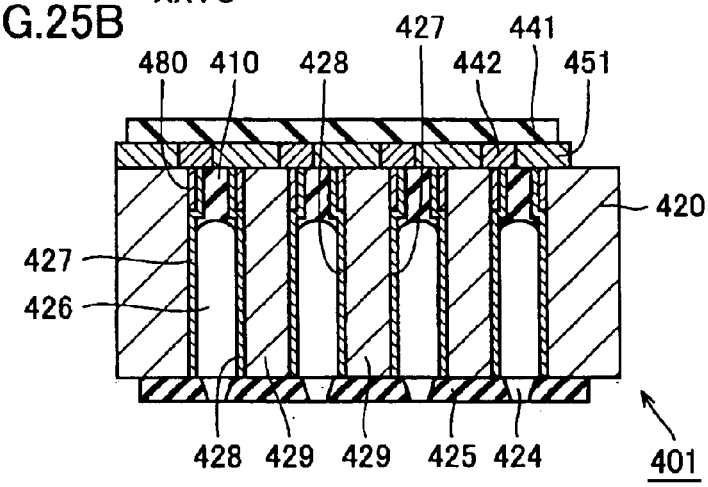

In the ink jet head of the present embodiment, an outer lead 442 on a TAB tape 441 conducting with drive IC 440 is directly connected, as shown in FIGS. 25A, 25B and 25C to at least one of electrodes 427 and 428 and the end plane of metal film 480 exposed at trailing end plane 421. According to this connection, by applying and curing an NCF 451 between TAB tape 441 or outer lead 442 and actuator 420, mechanical connection therebetween can be established.

Since the area of the end plane of metal film 480 is designed to be $60\times10^{-5}$ mm$^2$, sufficient reliability and stability of connection can be ensured. Also, in a manner similar to that above, electrical connection with an external circuit can be established even at the electrode end plane of ink chamber upper portion 422. Here, insulative resin 410 may be a conductive resin including, for example, an Ag filler. In this case, since the area of the cross section of the conductive particles of the conductive resin is included as the electrode area effective to connection with the outer lead at the cut plane, the stability and reliability of connection can be further improved.

A method of fabricating the ink jet head of the present embodiment will be described hereinafter.

Figure 26:
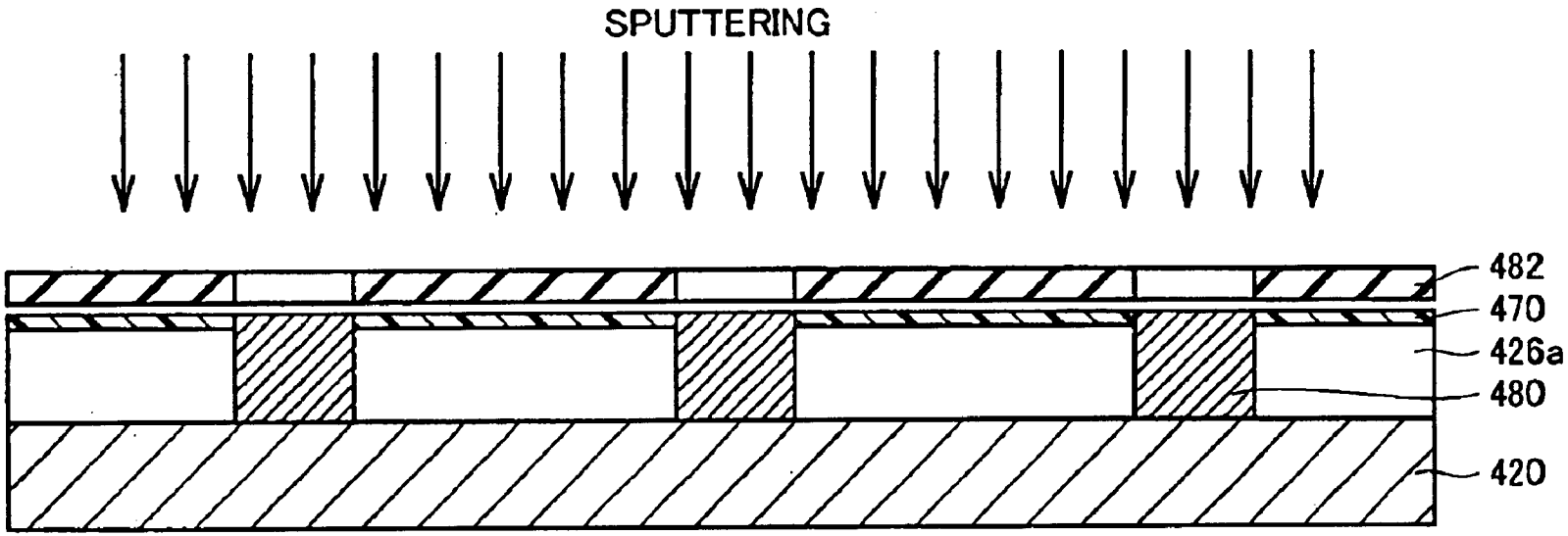
FIGS. 26, 27, 28 and 29 are perspective views of the ink jet head of the sixth embodiment, corresponding to a first step, a second step, and a third step, respectively, of a fabrication method thereof.

Referring to FIG. 26, a dry film resist 470 is laminated and cured at a surface of a piezoelectric element wafer (channel wafer) 420 polarized in the direction of thickness, as in the previous fifth embodiment. Then, channel wafer 420 is half-diced using a dicing blade of a dicer to form ink chamber trench 426*a*.

Following the formation of a plurality of ink chamber trenches 426*a* (ink chamber array), a metal mask 482 open at the portion corresponding to the trailing end portion of ink chamber trench 426*a* is disposed. By sputtering, a Cr contact layer and a Cu seed layer are formed to a thickness of 0.05 μm and 0.05 μm, respectively, at the open portion of metal mask 482.

Then, an electroless Ni plate not shown and a flush Au plating of a thickness of 1 μm and 0.05 μm, respectively, are attached to the region where the Cu seed layer is attached.

Figure 27:
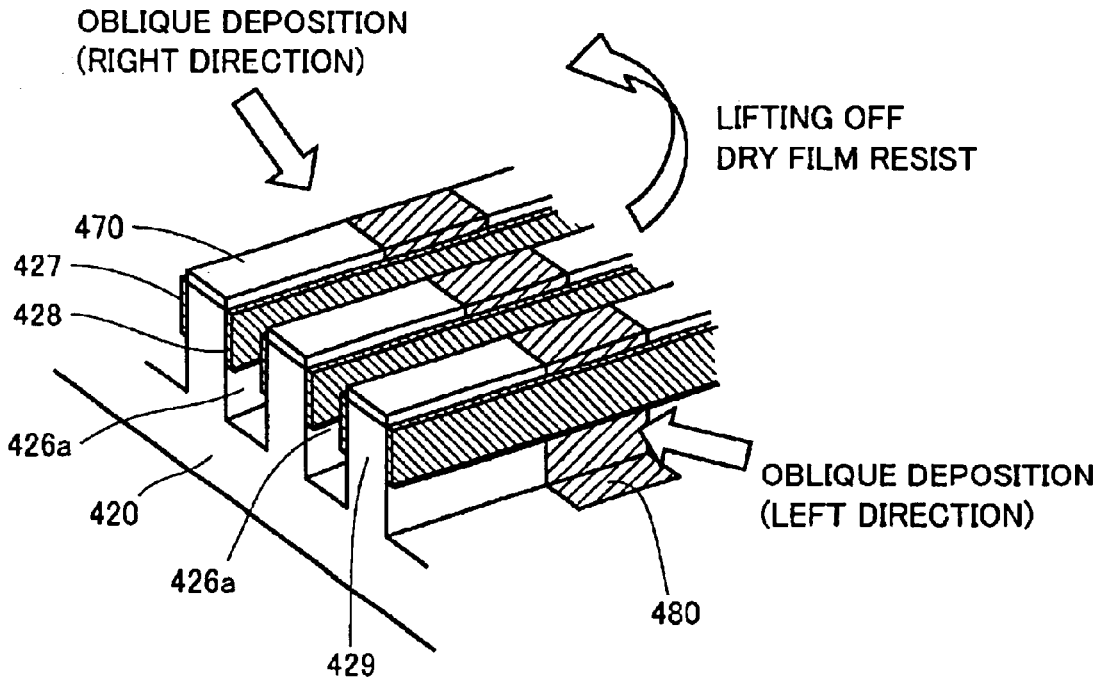

Referring to FIG. 27, an Al electrode is deposited obliquely to a thickness of 0.1 μm from a direction perpendicular to the longitudinal direction of ink chamber trench 426*a*. By carrying out this process from the left and right directions to the longitudinal direction of ink chamber trench 426*a*, metal electrodes 427 and 428 are formed at the surface of partition wall 429. By the shadowing effect of dry film resist in 170 and partition wall 429, metal electrodes 427 and 428 are formed to approximately ½ the depth of ink chamber trench 426A.

Then, by lifting off dry film resist 470, the electrical isolation between each ink chamber trench 426A can be ensured without formation of an electrode at the top plane of partition wall 429.

Figure 28:
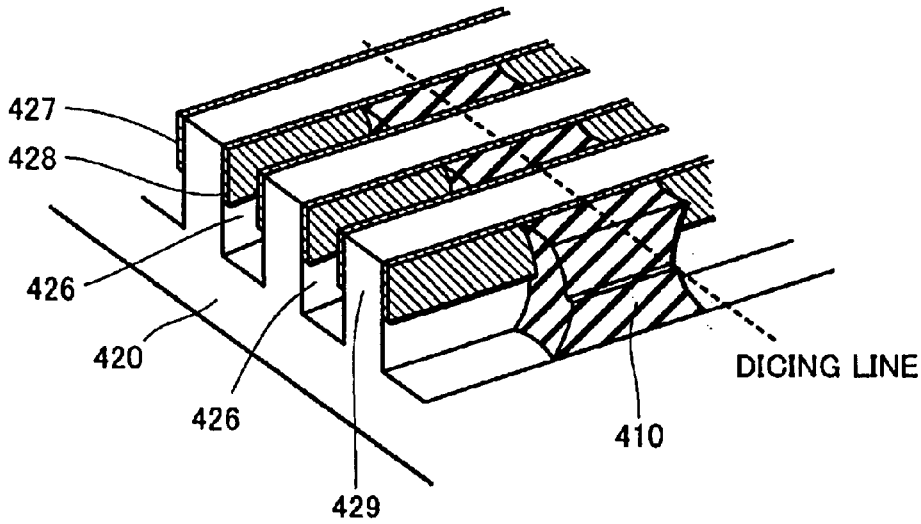

Referring to FIG. 28, liquid insulative resin 410 is applied in a direction orthogonal to the ink chamber array (an orthogonal direction to the longitudinal direction of ink chamber trench 426*a*) in a straight manner of 1 mm in width on ink chamber trench 426*a* and partition wall 429 using a dispenser or the like. By setting the viscosity of insulative resin 410 to not more than 10000 cps here, ink chamber trench 426*a* is easily filled with insulative resin 410.

Then, insulative resin 410 is cured by being left in an oven of 100° C. for one hour. Insulative resin 410 on partition wall 429 is ground away using a lapping film of number 600 and 1200. Accordingly, planarity between channel wafer 420 and the cover wafer (not shown) can be ensured in the subsequent wafer bonding process to allow favorable wafer bonding.

Figure 29:
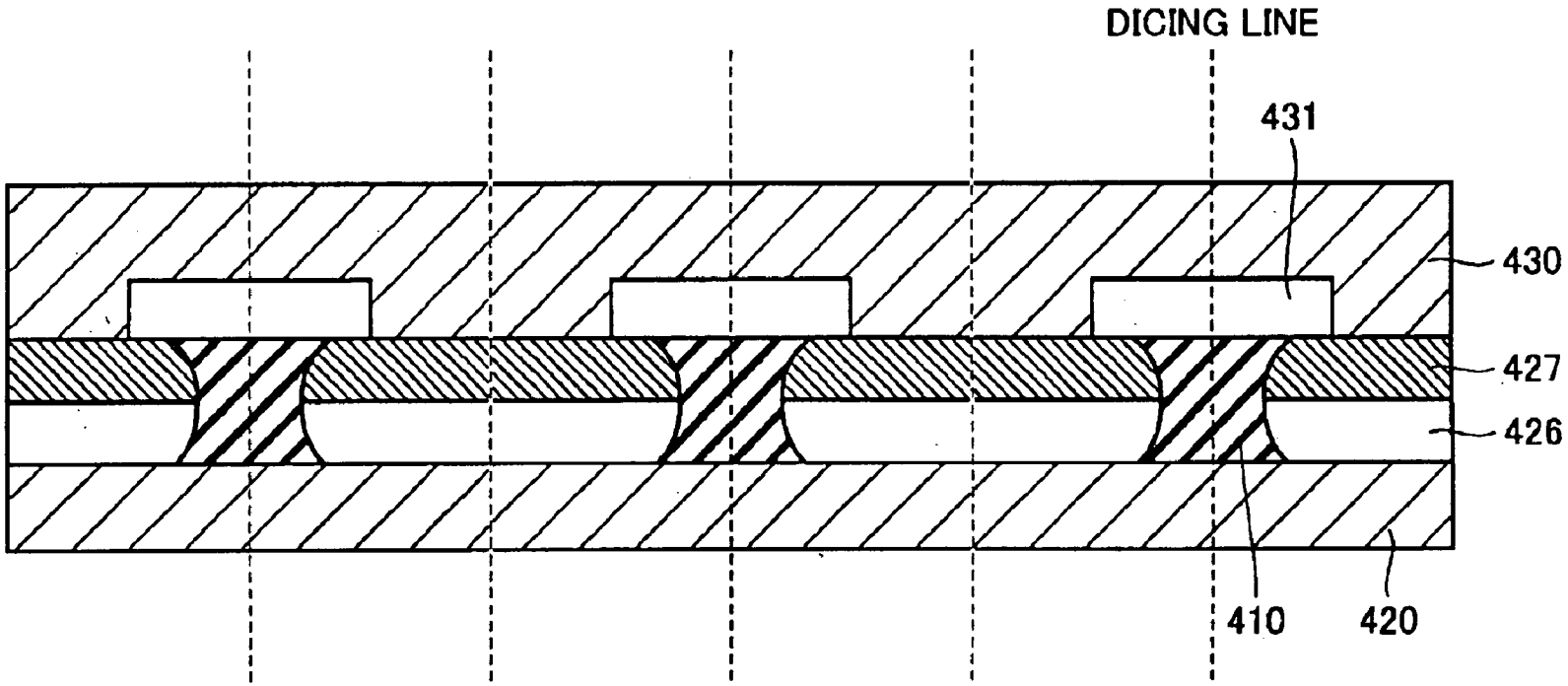
Figure 30:
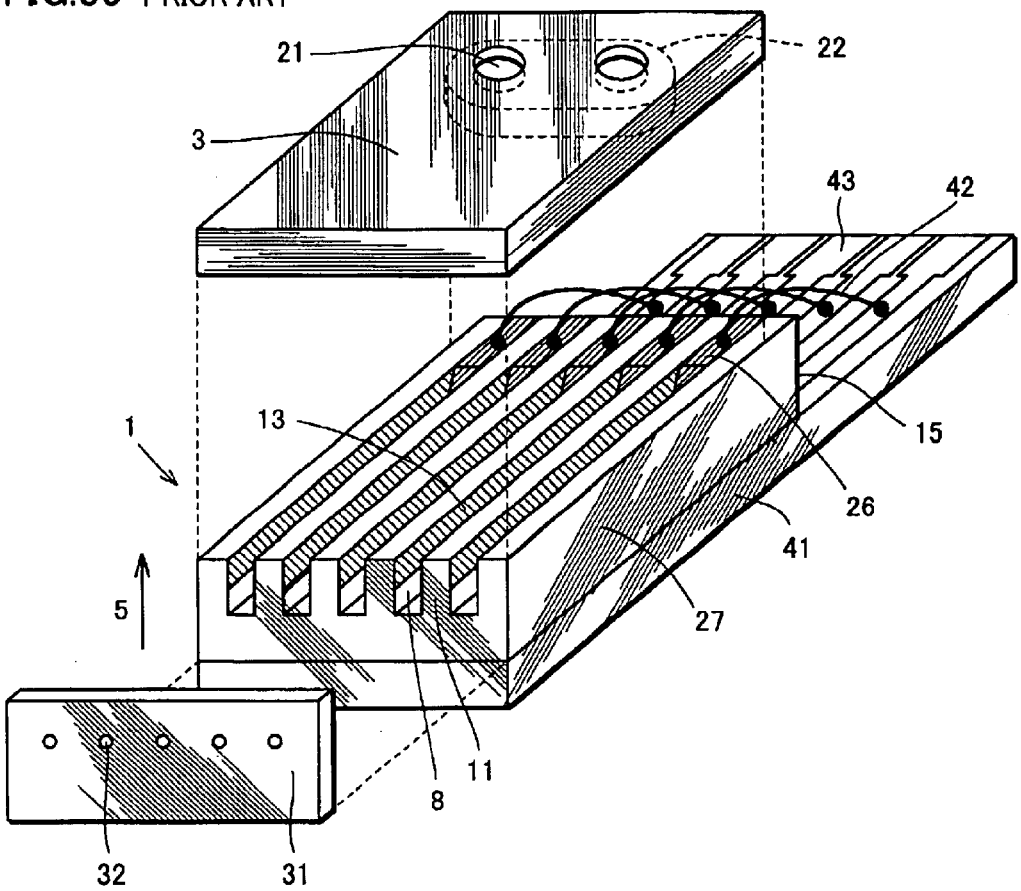
FIG.30 PRIOR ART
FIG. 30 is a perspective view showing a structure of a droplet spray apparatus of conventional art.
Figure 31:
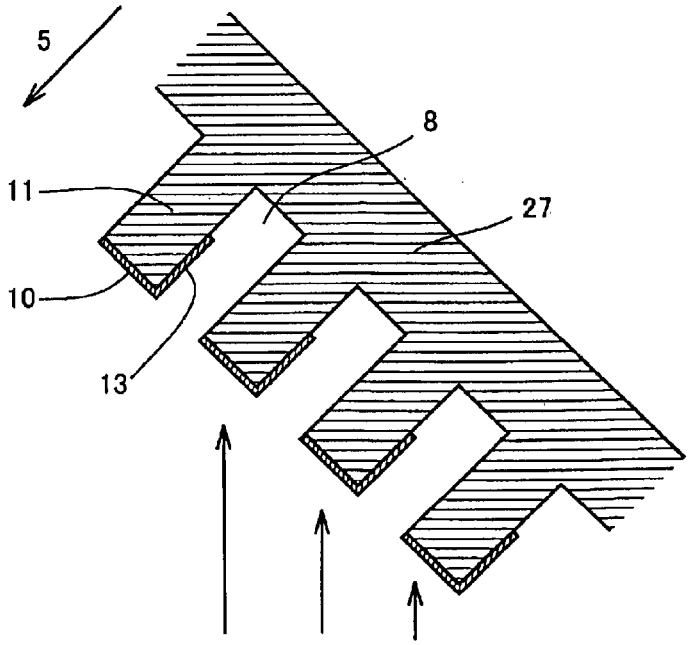
FIG.31 PRIOR ART
FIG. 31 is a diagram to describe the process of forming an electrode.
Figure 32:
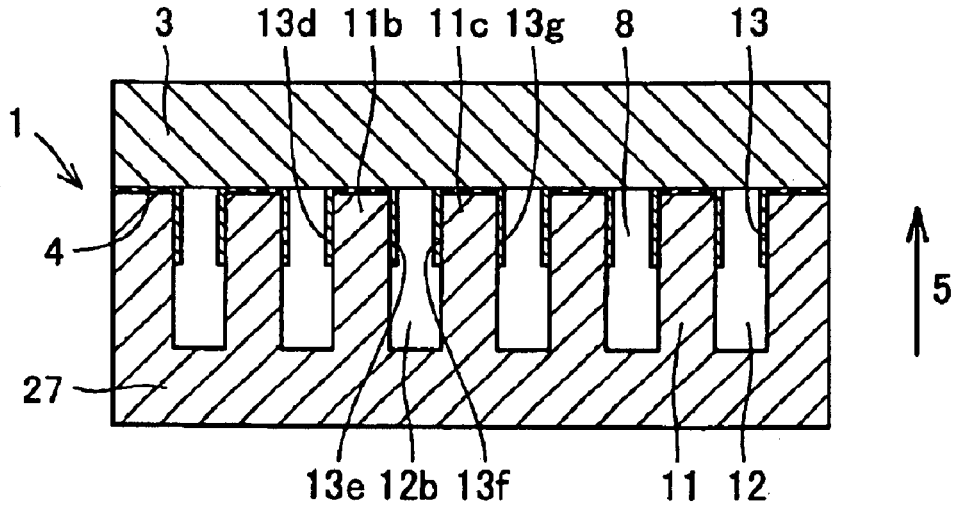
FIG.32 PRIOR ART
FIG. 32 is a sectional view of the droplets spray apparatus of the conventional art.
Figure 33:
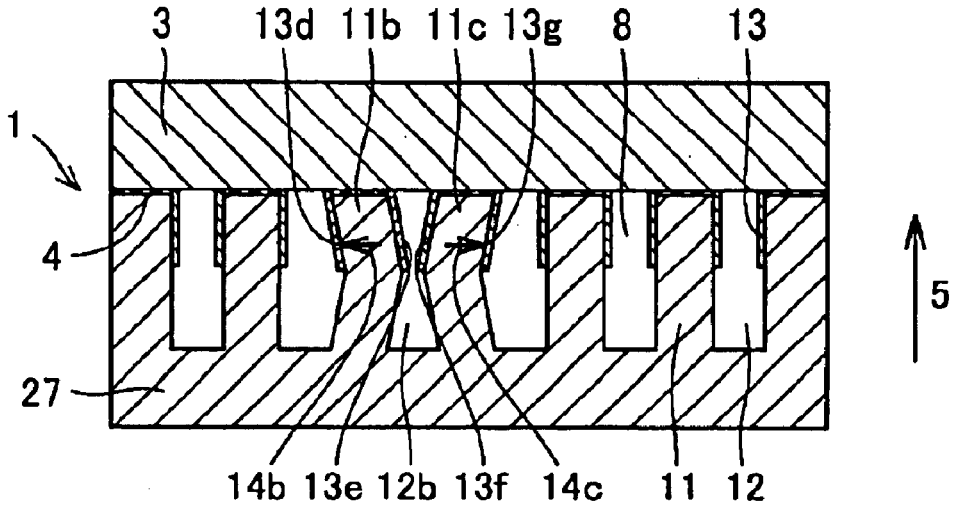
FIG.33 PRIOR ART
FIG. 33 is a diagram to describe an actuating state according to the conventional art.
Figure 34:
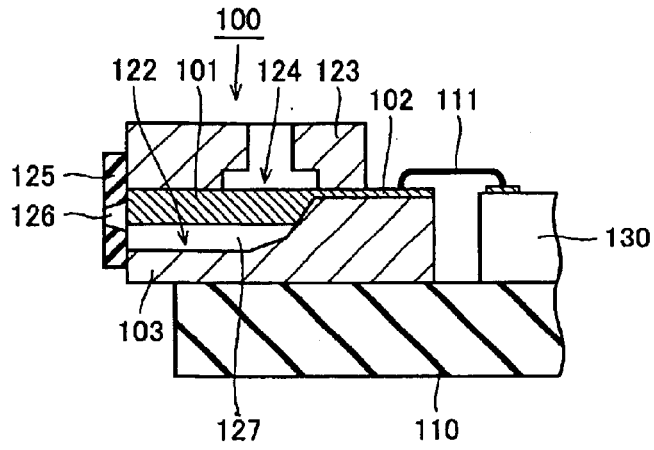
FIG.34 PRIOR ART
FIGS. 34, 35 and 36 are side sectional views of a conventional ink jet head corresponding to a first example, a second example, and a third example, respectively, of an electrode connection structure.
Figure 35:
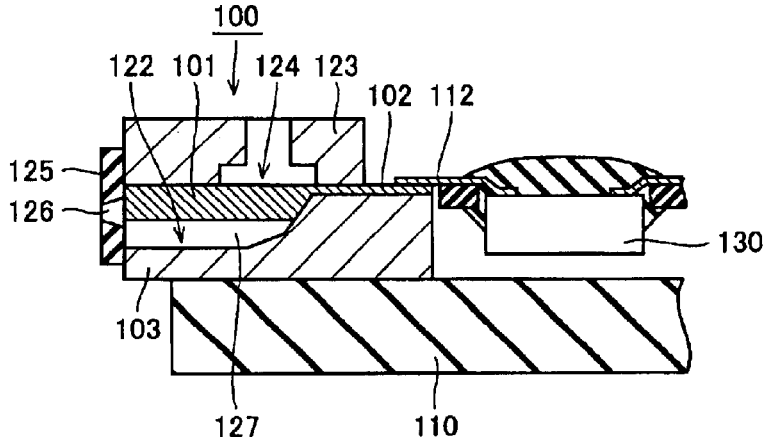
FIG.35 PRIOR ART
Figure 36:
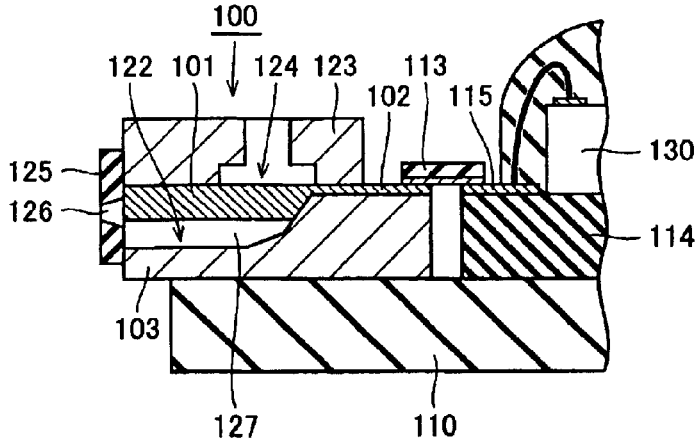
FIG.36 PRIOR ART
Figure 37:
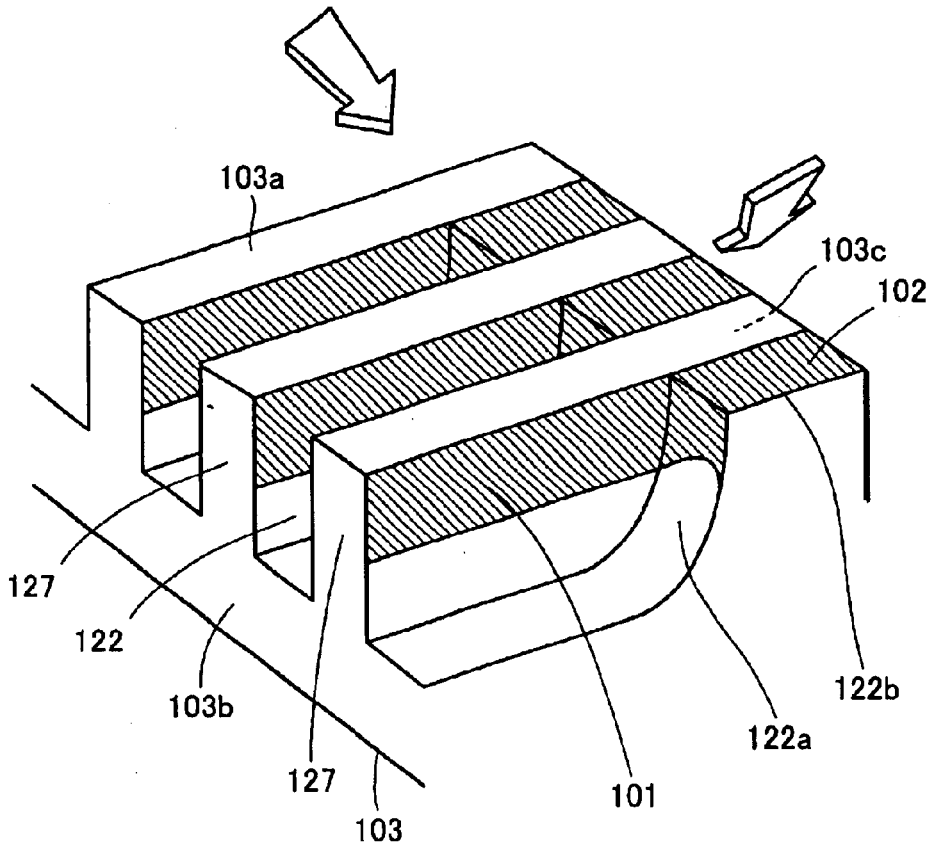
FIG.37 PRIOR ART
FIG. 37 is a perspective view of the main part of a conventional method of the fabricating an ink jet head.
Figure 38:
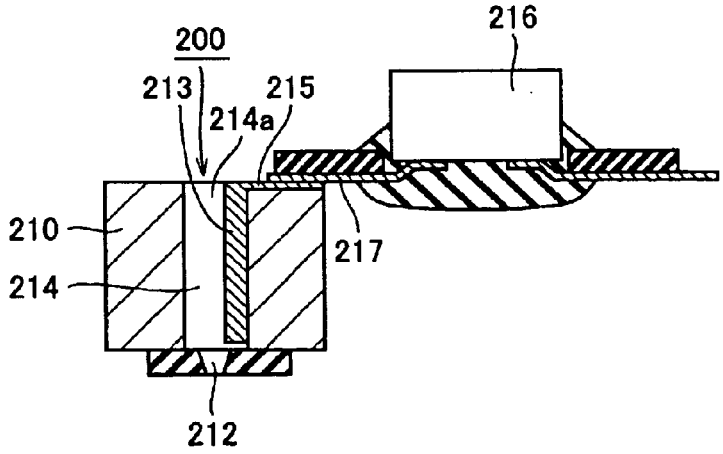
FIG.38 PRIOR ART
FIG. 38 is a side sectional view of a conventional ink jet head corresponding to a fourth example of an electrode connection structure.

Referring to FIG. 29, a cover wafer 430 formed of a piezoelectric element having the counterbore for ink supply opening 431 formed is prepared. Cover wafer 430 forms ink supply opening 431 when assembled into ink jet head, and becomes the cover member to close the top of ink chamber 426. In general, the material of cover wafer 430 is identical to that of piezoelectric element forming actuator 420 in order to match the coefficient of thermal expansion with actuator 420 match. However, the economic alumina ceramic with a relatively close coefficient of a thermal expansion can be used instead.

Wafer 420 having an ink chamber array formed and cover wafer 430 are attached with a commercially-available adhesive. Here, the portion where insulative resin 410 is filled is positioned so as to correspond to the center of the counterbore portion for ink supply opening 430, and attached together as in the fifth embodiment. Then, channel wafer 420 and cover wafer 430 are divided and cut by the dicing blade of a dicer at the counterbore portion for ink supply opening 431 and the applied portion of insulative resin 410 along the dicing line indicated by the broken line in FIG. 29, as in the fifth embodiment.

Here, the end face of electrodes 427 and 428 formed of Al and the end face of electrically conducting metal film 480 formed of Au/Ni/Cu/Cr are exposed at the cutting plane. In the connection with the lead conducting with the drive IC that is connected subsequently, the end faces of metal film 480 and electrodes 427 and 428 constitute the electrode for connection with the external circuit. The pushing load during the connection with the external circuit is received by the entire cut plane of the actuator. The pressing force is concentrated locally to prevent damage of the external circuit electrode. At this cut plane, ink supply opening 431 is open.

Insulative resin 410 is formed of an epoxy type resin having a silica filler dispersed. The elastic modulus is adjusted to 10 GPa. Therefore, the heat stress generated between the insulative resin in the ink chamber and the piezoelectric element can be alleviated by the elastic deformation of the insulative resin. The reliability of connection is superior.

In the present embodiment, advantages similar to those of the first embodiment can be achieved.

In the present embodiment, metal film 480 is electrically connected to electrodes 427 and 428. Therefore, by just connecting one of electrodes 427 and 428 with ink chamber trench 426*a* therebetween to the external drive circuit, both of electrodes 427 and 428 can be electrically connected.

At least one of electrodes 427 and 428 and metal film 480 has a coat of a metal film at the surface. Since electrodes 427 and 428 and metal film 480 are used as the electrode for connection with an external drive circuit, the electrode must be made thick enough. The formation of a metal film through a vacuum process such as vapor deposition and sputtering is disadvantageous in productivity since the throughput is slow. However, by forming the seed layer for plating thin by the vacuum process and forming a metal film of the desired thickness by plating, the productivity can be improved. The film quality of the metal film per se is uniform. The internal stress can be alleviated to reduce the defect of metal film peeling. An economic ink jet head stable in quality and high in reliability can be realized.

Each of electrodes 427 and 428 formed at the inner side plane of one pair of partition walls 429 is electrically connected by a metal film 480 formed along the inner wall plane of ink chamber trench 426*a*. When each of electrodes 427 and 428 formed at each inner side plane of one pair of partition walls 429 is not electrically connected to metal film 480, i.e., electrically separated, the external electrode conducting with the external drive circuit must be connected to the end plane of each of electrodes 427 and 428 when connection of the electrode conducting with an internal drive circuit is to be established through the ACA.

However, as long as each of electrodes 427 and 428 forming a pair is electrically connected by metal film 480, the external electrode of the external drive circuit only has to be connected to the end plane of one of electrodes 427 and 428 using at least one ACA conductor particle in the electrode connection with the external electrode conducting with the external drive circuit through the ACA. Therefore, the density of the scattering conductor particles of the ACA can be reduced, which allows reduction in the cost of the ACA material and is advantageous from the standpoint of insulation with respect to electrodes 427 and 428 of an adjacent ink chamber trench. Accordingly, the pitch can be reduced. Thus, an economic ink jet head that allows print out at high accuracy can be provided.

The fabrication method of an ink jet head further includes the step of forming a metal film 480 along an inner wall plane of ink chamber trench 426*a*. Electrodes 427 and 428 are formed so as to come into contact with metal film 480. Accordingly, the connection with the electrode conducting with an external drive circuit performed subsequently can exhibit high mounting reliability by forming a thick metal film carried out at another step. Also, the throughput of the vacuum process is increased to improve the productivity since the electrode does not have to be made as thick as electrodes 427 and 428. Furthermore, power consumption can be reduced without increasing the driving load of the active area of the ink jet head driven in a shear mode.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet head deforming a pair of partition walls sandwiching an ink chamber trench to discharge ink from said ink chamber by having an inside electrode formed in the ink chamber at each inner side plane of said pair of partition walls and electrically connected to an external drive circuit, and applying a driving pulse from said external drive circuit to said inside electrodes, comprising:

a substrate having said partition walls constituted by forming said ink chamber trench from one end plane to another end plane; and a filling member formed between said pair of partition walls at said another end plane of said ink chamber trench, wherein an end plane of said inside electrode located only within said ink chamber trench is exposed at said another end plane, said external drive circuit is electrically connected to said inside electrode at said another end plane, and an ink supply opening to supply ink to said ink chamber trench is provided at said another end plane side, and wherein said ink chamber trench extends from said one end plane to said another plane and maintains a constant depth.

2. The ink jet head according to claim 1, further comprising a cover plate attached at a surface of said substrate where said ink chamber trench is formed, wherein said ink supply opening is provided at least at said cover plate side.

3. The ink jet head according to claim 1, further comprising a protection film to protect a connection portion where said inside electrode and said external drive circuit are electrically connected via said filling member having conductivity.

4. The ink jet head according to claim 1, wherein said filling member is formed of a conductive material, and said external drive circuit and said inside electrode are electrically connected via said filling member.

5. The ink jet head according to claim 4, wherein said filling member includes a conductive resin occluding said ink chamber trench at said another end plane between said pair of partition walls.

6. The ink jet head according claim 5, wherein said filling member includes a conductive filler of a predetermined material and a predetermined configuration.

7. The ink jet head according to claim 4, wherein said filling member is solder occluding said ink chamber trench between each inside electrode formed at each wall plane of said pair of partition walls at said another end plane.

8. The ink jet head according to claim 4, wherein said filling member is electrically connected to a connection terminal of said external drive circuit at a region exposed at said ink chamber trench.

9. The ink jet head according to claim 4, wherein said filling member is a connection terminal of said external drive circuit inserted into said another end plane of said ink chamber trench.

10. The ink jet head according to claim 9, wherein one of said inside electrode and said filling member is deformed by abutment with the other of said inside electrode and said filling member during insertion of said filling member into said another end plane of said ink chamber trench.

11. The ink jet head according to claim 4, wherein said filling member includes a conductive resin occluding said ink chamber trench between each said inside electrode formed at each wall plane of said pair of partition walls at said another end plane, and a connection terminal of said external drive circuit inserted into said another end plane of said ink chamber trench.

12. The ink jet head according to claim 4, wherein said filling member occluding said ink chamber trench between each said inside electrode formed at each wall plane of said pair of partition walls is an anisotropic conductive adhesive.

13. The ink jet head according to claim 4, wherein a guide portion of a configuration to guide said filling member into said ink chamber trench is formed at said another side plane of said ink chamber trench.

14. The ink jet head according to claim 1, further comprising a connection conductor layer electrically connected to said inside electrode, wherein an end plane of said connection conductive layer located at only inside said ink chamber trench is exposed at said another end plane, and electrical connection with said external drive circuit is established at the exposed end plane of said connection conductor layer.

15. The ink jet head according to claim 14, wherein at least one of said inside electrode and said connection conductor layer includes a plating metal film at its surface.

16. The ink jet head according to claim 14, wherein each inside electrode formed at each inner side plane of said pair of partition walls is electrically connected by said connection conductor layer formed along an inner wall plane of said ink chamber trench.

17. The ink jet head according to claim 1, wherein an area of a cross section of the end plane of said inside electrode exposed at said another end plane is at least $7\times10^{-5}$ $mm^{2}$.

18. The inkjet head according to claim 1, wherein said filling member includes a substance of one of a conductive resin and an insulative resin.

19. The ink jet head according to claim 18, wherein said filling member has characteristics of at least an elastic modulus of not more than 10 GPa under an environment of not more than 100° C. and a coefficient of linear expansion of not more than 50 ppm/° C. under an environment of not more than 100° C.

* * * * *